US009517913B2

(12) United States Patent
Aizawa et al.

(10) Patent No.: US 9,517,913 B2
(45) Date of Patent: Dec. 13, 2016

(54) ACCUMULATING UNIT AND PRINT PRODUCT PRODUCTION DEVICE

(71) Applicant: Kabushiki Kaisha Tokyo Kikai Seisakusho, Tokyo (JP)

(72) Inventors: Shunsuke Aizawa, Kisarazu (JP); Kenichi Yamagiwa, Kisarazu (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 19 days.

(21) Appl. No.: 14/681,496

(22) Filed: Apr. 8, 2015

(65) Prior Publication Data

US 2015/0307309 A1 Oct. 29, 2015

(30) Foreign Application Priority Data

Apr. 10, 2014 (JP) ..... 2014-081221

(51) Int. Cl.
*B65H 35/00* (2006.01)
*B65H 29/52* (2006.01)
(Continued)

(52) U.S. Cl.
CPC ..... *B65H 35/0006* (2013.01); *B65H 20/02* (2013.01); *B65H 20/06* (2013.01); *B65H 29/22* (2013.01); *B65H 29/52* (2013.01); *B65H 29/68* (2013.01); *B65H 31/00* (2013.01); *B65H 31/02* (2013.01); *B65H 31/20* (2013.01); *B65H 31/24* (2013.01); *B65H 31/3027* (2013.01); *B65H 31/38* (2013.01); *B65H 37/06* (2013.01); *B65H 43/00* (2013.01); *B65H 45/12* (2013.01); *B65H 45/18* (2013.01); *B65H 2301/4212* (2013.01); *B65H 2301/4227* (2013.01);
(Continued)

(58) Field of Classification Search
CPC ..... B65H 35/006; B65H 20/02; B65H 20/06; B65H 29/22; B65H 29/52; B65H 29/68; B65H 31/00; B65H 31/02; B65H 31/20; B65H 31/24; B65H 31/3027; B65H 31/38; B65H 37/06; B65H 43/00; B65H 45/12; B65H 45/18
USPC ..... 270/32, 45; 493/444, 445
See application file for complete search history.

(56) References Cited

U.S. PATENT DOCUMENTS 5,462,399 A * 10/1995 Clupper ..... B65H 39/06 270/58.18
5,623,722 A * 4/1997 Hawley ..... B65H 29/12 270/58.01
(Continued)

FOREIGN PATENT DOCUMENTS

JP S5651749 U 5/1981
JP 7267460 A 10/1995
(Continued)

*Primary Examiner* — Patrick Mackey
(74) *Attorney, Agent, or Firm* — The Webb Law Firm

(57) ABSTRACT

In a sheet or signature (printer folder sheet) accumulating a front positioning part 44 configured, when a sheet has entered a sheet accumulating part 40, to move away from a rear positioning part 46 such that a distance of the front positioning part 44 from the rear positioning part 46 is larger than a length of the sheet in a carrying-in direction of the sheet, and, after a front edge in the carrying-in direction of the sheet has contacted the front positioning part 44, to move closer to the rear positioning part 46.

12 Claims, 12 Drawing Sheets

(51) Int. Cl.

| | |
|---|---|
| ***B65H 29/68*** | (2006.01) |
| ***B65H 31/02*** | (2006.01) |
| ***B65H 31/20*** | (2006.01) |
| ***B65H 31/24*** | (2006.01) |
| ***B65H 31/38*** | (2006.01) |
| ***B65H 45/18*** | (2006.01) |
| ***B65H 20/02*** | (2006.01) |
| ***B65H 20/06*** | (2006.01) |
| ***B65H 29/22*** | (2006.01) |
| ***B65H 31/00*** | (2006.01) |
| ***B65H 31/30*** | (2006.01) |
| ***B65H 37/06*** | (2006.01) |
| ***B65H 43/00*** | (2006.01) |
| ***B65H 45/12*** | (2006.01) |

(52) U.S. Cl.

CPC .... *B65H 2301/45* (2013.01); *B65H 2404/561* (2013.01); *B65H 2404/61* (2013.01); *B65H 2405/115* (2013.01); *B65H 2405/1122* (2013.01); *B65H 2405/1134* (2013.01); *B65H 2405/142* (2013.01); *B65H 2701/1932* (2013.01)

(56) References Cited

U.S. PATENT DOCUMENTS

| | | | | |
|---|---|---|---|---|
| 5,810,346 | A * | 9/1998 | Jorg | B65H 39/02 198/349.9 |
| 6,164,640 | A * | 12/2000 | Stengl | B65H 39/06 271/187 |
| 7,631,866 | B2 * | 12/2009 | Otomo | B65H 9/06 271/225 |
| 7,798,950 | B2 * | 9/2010 | Kobayashi | B65H 45/18 270/20.1 |
| 7,900,904 | B2 * | 3/2011 | Herrmann | B65H 31/24 270/52.14 |
| 8,118,295 | B2 * | 2/2012 | Marcinik | B42B 4/00 270/52.18 |
| 8,162,306 | B2 * | 4/2012 | Suzuki | B65H 31/34 270/58.12 |

FOREIGN PATENT DOCUMENTS

| | | | |
|---|---|---|---|
| JP | 201276880 | A | 4/2012 |
| JP | 5252356 | B2 | 4/2013 |
| JP | 5283237 | B2 | 6/2013 |

* cited by examiner

ACCUMULATING UNIT AND PRINT PRODUCT PRODUCTION DEVICE

CROSS REFERENCE TO RELATED APPLICATION

This application is based upon and claims the benefit of priority from prior Japanese Patent Application No. 2014-081221, filed on Apr. 10, 2014, the entire contents of which are incorporated herein by reference.

BACKGROUND OF THE INVENTION

Field of the Invention

The present invention relates to an accumulating unit for accumulating individual or signature form sheets conveyed thereto and forming a sheet stacked body, and to a print product production device employing this accumulating unit.

Description of the Related Art

In a rotary press which is a typical device for producing a newspaper form signature (printer folder sheet), as well as it being possible to produce a one section newspaper signature of the kind of an ordinary daily newspaper, it is also possible to produce a multi-section newspaper signature in which a plurality of kinds of section signatures such as, for example, a section signature carrying news of society in general, a section signature carrying local news, and a section signature carrying sports information are overlaid, and the overlaid section signatures are folded in two and formed into a bundle by the outer section signature.

Incidentally, recently, a digital printing newspaper production device is known as a device that is preferable for producing various kinds of newspaper signatures in small numbers of copies without the need for a plate and that does not require large scale facilities like a rotary press, and is disclosed by Patent Document 1 indicated below. Moreover, technology disclosed in Patent Document 2 indicated below is publicly known as a section signature accumulating device that forms a section signature stacked body of overlaid section signatures to be delivered to the next process.

The device disclosed in Patent Document 1 prints a continuous paper supplied from a continuous paper supply unit, by a digital printing unit, and then cuts the printed continuous paper into sheets by a cutting cylinder of a section formation unit and, by cooperation of a folding cylinder and a jaw cylinder, produces, from one sheet or by overlapping a plurality of sheets, a section signature folded in two in a width direction of the sheet (sideways fold). Next, in a section signature accumulating device, the received section signatures are overlaid in an accumulating part to form a section signature stacked body, the section signature stacked body is released from the accumulating part to a delivery mechanism at a timing when a certain number of copies of the section signatures have finished being overlaid, the section signature stacked bodies are intermittently sent forth by the delivery mechanism to a chopper folding mechanism on a downstream side, and the section signature stacked body that has reached a certain chopper folding position is lengthways-folded in the chopper folding mechanism at an appropriate timing to produce a signature form print product.

The technology disclosed in Patent Document 2 relates to a section signature accumulating device and section signature accumulating method that conveys, by a conveyor belt of a variable speed conveyor part, section signatures sent forth N (where N is an integer of 2 or more) copies at a time from a pre-processing unit, distributes the section signatures one copy at a time in a distributing and conveying part and conveys and stocks the section signatures to each of section signature accumulating parts, thereby forming N section signature stacked bodies each having one or more copies of the section signature overlaid in a good posture therein to be delivered to a post-processing unit.

[Patent Document 1] Japanese Patent No. 5252356

[Patent Document 2] Japanese Patent No. 5283237

SUMMARY OF THE INVENTION

However, there is a problem that when operating the device disclosed in above-described Patent Document 1 at high speed, the section signature conveyed at high speed is released into a space of the accumulating part of the section signature accumulating device with its momentum unchanged, hence a leading edge of the section signature collides vigorously with a front sidewall of the accumulating part and rebounds from the front sidewall such that a part of the section signature rides up on one of the three sidewalls other than the front sidewall, and a section signature stacked body (sheet accumulated body) overlaid in a good posture cannot be formed.

Note that the inventor of the present application attempted to solve such a problem using the technology disclosed in above-described Patent Document 2. That is, the inventor configured to provide a variable speed conveyor part to lower a conveying speed while the section signature sent forth from the pre-processing unit is conveyed to the accumulating part of the section signature accumulating device and thereby weaken the momentum with which the section signature is released into the space of the accumulating part of the section signature accumulating device and the leading edge of the section signature collides with the front sidewall of the accumulating part. However, when speed is lowered by the variable speed conveyor part, a spacing between a rear end of a leading section signature and a leading end of a following section signature gets shortened, thereby generating a fundamental problem that it becomes impossible to secure operating time of the distributing/conveying mechanism downstream of the variable speed conveyor part and a mechanism that discharges the section signature stacked body to the delivery mechanism on a downstream side, whereby operation of the device becomes impossible.

The present invention was made in view of the above problems of the conventional technology, and an object of the present invention is to provide an accumulating unit capable of overlaying a sheet stacked body in a good posture even during high speed operation, and to provide a print product production device.

An accumulating unit according to the present invention is an accumulating unit for accumulating in a sheet accumulating part an individual or signature form sheet carried from an upstream side, the sheet accumulating part comprising: a front positioning part that is provided on a front side in a carrying-in direction of the sheet carried into said sheet accumulating part and that positions a front edge in the carrying-in direction of the sheet; and a rear positioning part that is provided facing the front positioning part on a rear side in the carrying-in direction of said sheet and that positions a rear edge in the carrying-in direction of the sheet, the front positioning part being configured to, when the sheet has entered the sheet accumulating part, move away from the rear positioning part such that a distance of the front positioning part from the rear positioning part is larger than a length of the sheet in the carrying-in direction of the sheet, and, after the front edge in the carrying-in direction of the sheet has contacted the front positioning part, move closer to the rear positioning part such that the distance of the front positioning part from the rear positioning part is substantially equal to the length of the sheet in the carrying-in direction of the sheet.

In the accumulating unit according to the present invention, it is preferable that the sheet accumulating part further comprises a paper guide provided above an accumulating position between the front positioning part and the rear positioning part, and the paper guide includes an inclined portion that inclines downward toward the accumulating position and that is configured to guide the sheet that has entered the sheet accumulating part to the accumulating position by a lower surface of the inclined portion. In this case, it is preferable that the lower surface of the inclined portion is provided with a frictional resistance increasing member that increases frictional resistance to more than when the sheet that has entered the sheet accumulating part contacts the lower surface of the inclined portion directly. In addition, it is preferable that a leading edge on a front positioning part side of the inclined portion is horizontal and bent in a direction toward the front positioning part.

Moreover, in the accumulating unit according to the present invention, it is preferable that the rear positioning part is configured to be movable in a direction of moving closer to or moving away from the front positioning part.

Furthermore, in the accumulating unit according to the present invention, it is preferable that the sheet accumulating part further comprises a pair of side positioning parts that positions a position in a width direction of the sheet accumulated in said sheet accumulating part. In this case, it is preferable that at least one of the pair of side positioning parts is configured to move away from the other of the side positioning parts such that a distance between the pair of side positioning parts is larger than a length of the sheet in the width direction of the sheet, and then move closer to the other of the side positioning parts such that the distance between the pair of side positioning parts is substantially equal to the length of the sheet in the width direction of the sheet.

Still further, it is preferable that the accumulating unit according to the present invention further comprises a chopper folding mechanism that is provided above a region of the sheet accumulating part where the sheet is accumulated and that folds in two a sheet stacked body configured from one or a plurality of sheets accumulated in said sheet accumulating part.

Moreover, a print product production device according to the present embodiment comprises: an upstream side conveyor part that conveys an individual or signature form sheet on which printing has been performed; a plurality of accumulating units; and a distributing and conveying part that is provided between the upstream side conveyor part and the plurality of accumulating units and that distributes and conveys the sheet conveyed by the upstream side conveyor part to each of the plurality of accumulating units, the plurality of accumulating units each being the above-mentioned accumulating unit.

The present invention makes it possible to provide an accumulating unit that, by a front positioning part, can moderate momentum of a sheet that has entered a sheet accumulating part and perform paper alignment of sheets accumulated in the sheet accumulating part, and is hence capable of overlaying a sheet stacked body in a good posture even during high speed operation, and to provide a print product production device.

DETAILED DESCRIPTION OF THE EMBODIMENTS

Preferred embodiments for carrying out the present invention are described below with reference to the drawings. Note that the following embodiments are not intended to limit the inventions set forth in the claims, and the combinations of features described in the embodiments are not all necessarily indispensable for the means for solving the problem provided by the invention.

Figure 1:
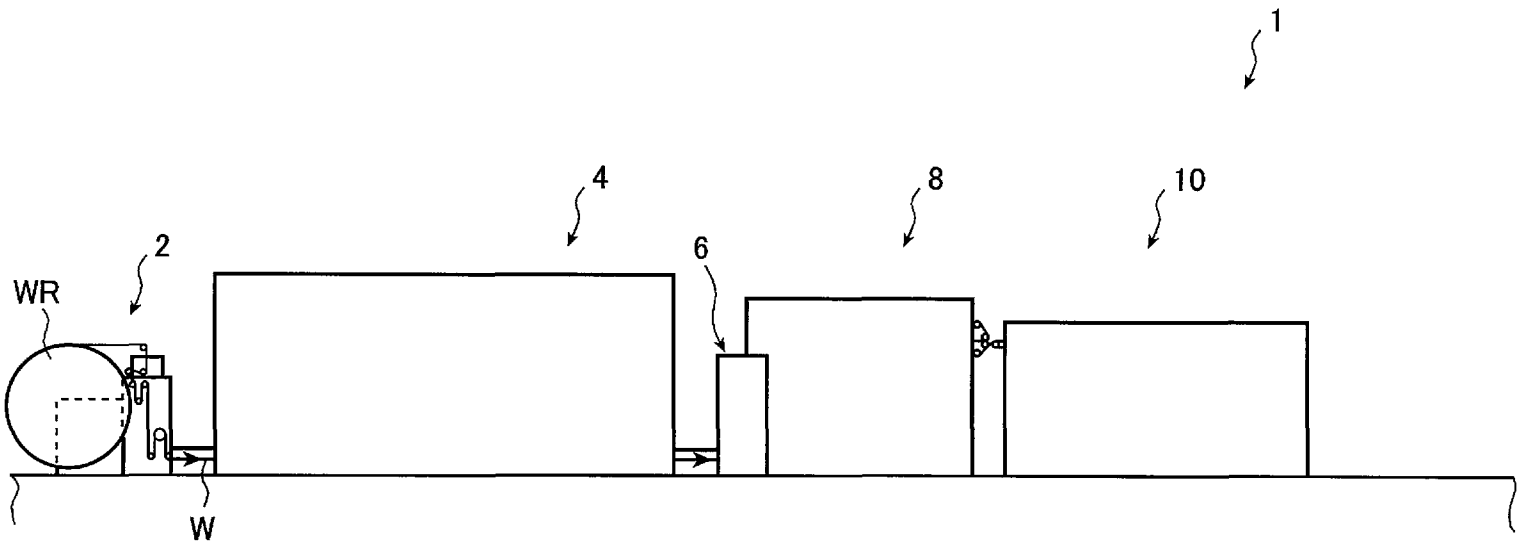
FIG. 1 is a schematic elevation view showing an overall configuration of a print product production device according to a present embodiment.

As shown in FIG. 1, a print product production device 1 according to a present embodiment comprises: a continuous paper supply unit 2 having roll paper WR set therein, the roll paper WR being a continuous paper W wound in a roll shape; an ink jet printing unit 4 that performs ink jet printing (digital printing) on both sides of the continuous paper W supplied from the continuous paper supply unit 2; a print surface monitoring unit 6 that monitors (inspects) a printed paper surface of the continuous paper W; a folding device 8 that cuts the post-ink jet printing continuous paper W to form single individual sheets (flat papers) and folds one individual sheet or an individual sheet group configured from two or more individual sheets to forma signature form sheet (referred to below as a signature); an accumulating mechanism 10 that accumulates one or more copies of the signature formed by the folding device 8 to form a sheet stacked body (section signature stacked body) and folds the formed sheet stacked body to form a signature form print product; and one or a plurality of control units (not illustrated) that execute various kinds of control of each configuration.

In the print product production device 1 according to the present embodiment, a variety of publicly known continuous paper supply units and print surface monitoring units may be employed as the continuous paper supply unit 2 and the print surface monitoring unit 6, hence descriptions thereof will be omitted. Moreover, the ink jet printing unit 4 is configured to be capable of continuously printing any number at a time of pages of identical or different content in any order on the continuous paper W, based on a preset composition of the signature and print product. A variety of publicly known ink jet printing units may be employed as such an ink jet printing unit, hence a description thereof will be omitted.

Figure 2:
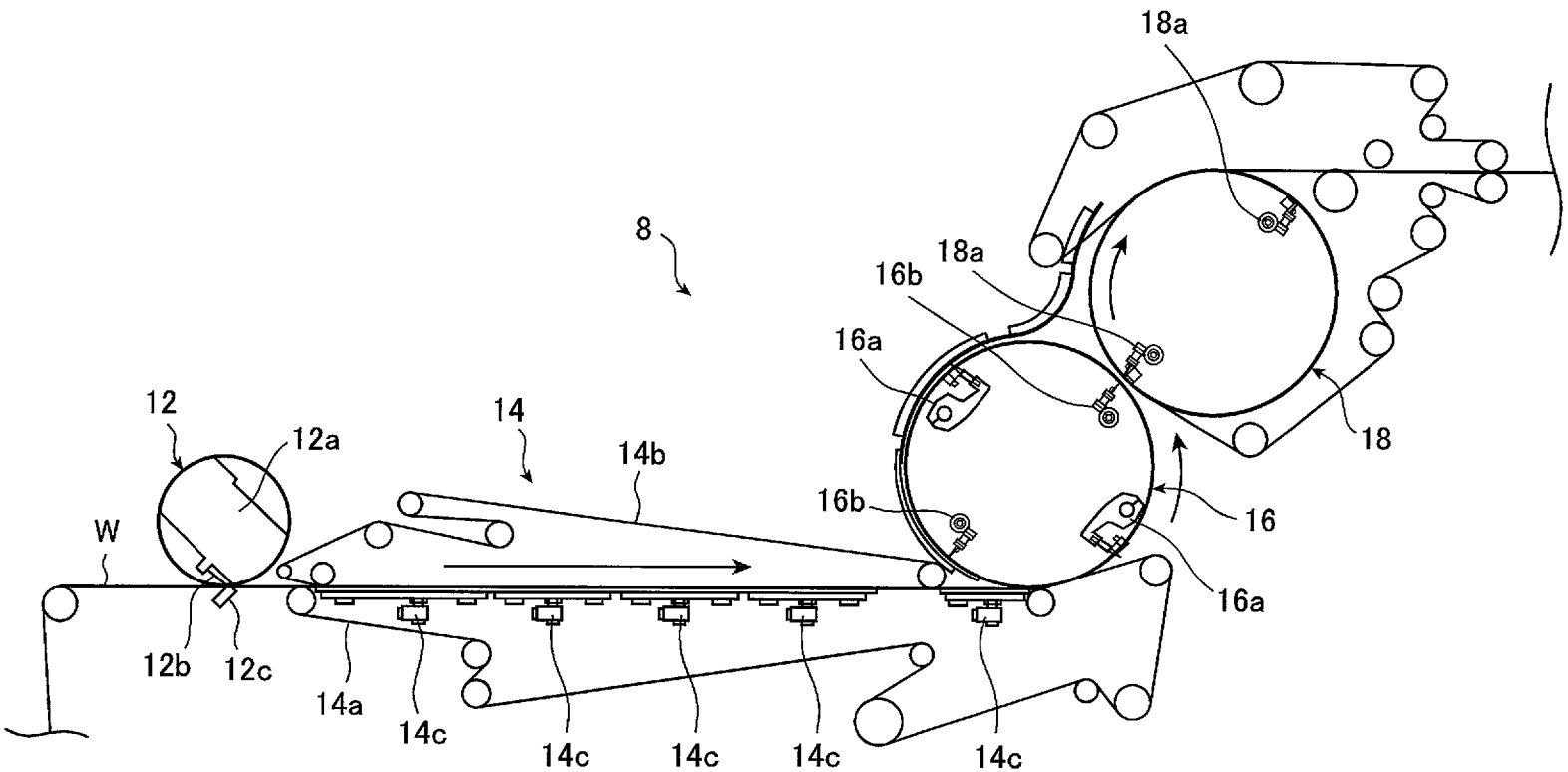
FIG. 2 is a schematic configuration diagram showing a folding device according to the present embodiment.

As shown in FIG. 2, the folding device 8 comprises: a cutting mechanism 12 that cuts the post-ink jet printing continuous paper W to form single individual sheets; a conveyor mechanism 14 that conveys the post-cutting individual sheets to a downstream side; a folding cylinder 16 that sequentially wraps around itself the individual sheets conveyed continuously from the conveyor mechanism 14 (that is, an upstream side); and a jaw cylinder 18 that receives from the folding cylinder 16 one individual sheet or an individual sheet group configured from two or more individual sheets in a state of having been folded in two, and conveys the one individual sheet or individual sheet group configured from two or more individual sheets to an accumulating mechanism 10 side (that is, a downstream side).

The cutting mechanism 12 is a rotary cutting mechanism comprising: a cutter cylinder 12*a* of columnar shape having a certain circumferential length; a cutter blade 12*b* having a blade edge capable of cutting the continuous paper W in a width direction; and a cutter blade receiver 12*c* provided facing the cutter cylinder 12*a* bounded by the supplied continuous paper W. The cutting mechanism 12 is configured to cut the continuous paper W one time every time the cutter cylinder 12*a* makes one rotation and form the individual sheet. Circumferential speed of the cutter cylinder 12*a* is configured capable of being appropriately adjusted automatically or manually according to a length in a conveying direction (cutoff) of the individual sheet being produced. That is, the cutting mechanism 12 is configured to be capable of handling also so-called variable cutoff where by changing the circumferential speed of the cutter cylinder 12*a* to any circumferential speed, the length in the conveying direction (cutoff) of the individual sheet is changed to any cutting length.

The conveyor mechanism 14 comprises: a lower conveyor belt 14*a* provided in a region from close on a downstream side to the cutting mechanism 12 to a lower portion of the folding cylinder 16; an upper conveyor belt 14*b* provided in a region from close on a downstream side to the cutting mechanism 12 to close on an upstream side to the folding cylinder 16; and a plurality of lower suction devices 14*c* installed below a conveying path of the individual sheet in the lower conveyor belt 14*a*. The conveyor mechanism 14 is configured to convey the individual sheet cut by the cutting mechanism 12 toward the folding cylinder 16 by cooperation of the lower conveyor belt 14*a* and the upper conveyor belt 14*b*.

The lower conveyor belt 14*a* has a plurality of suction holes (not illustrated) formed therein, and is configured to be capable of transmitting suction from the lower suction device 14*c* to the individual sheet on the lower conveyor belt 14*a* via the suction holes of the lower conveyor belt 14*a*. The conveyor mechanism 14 comprising such a configuration makes it possible for the individual sheet to be reliably conveyed in a restrained state by grip due to the lower conveyor belt 14*a* and upper conveyor belt 14*b* and suction due to the lower suction device 14*c*.

The lower conveyor belt 14*a* and the upper conveyor belt 14*b* are synchronously controlled by a control unit (not illustrated) to rotate with the same speed. Specifically, the lower conveyor belt 14*a* and the upper conveyor belt 14*b* are controlled by a control unit (not illustrated) to convey the individual sheet with any speed faster than a conveying speed of the continuous paper W supplied to the cutting mechanism 12, in the present embodiment with a speed about 5% faster than the conveying speed of the continuous paper W. In this way, by conveying the individual sheet cut by the cutting mechanism 12 with a speed faster than the conveying speed of the continuous paper W, the conveyor mechanism 14 can forma certain gap between each of the individual sheets. The conveying speed of the individual sheet by the conveyor mechanism 14, that is, a drive speed of the lower conveyor belt 14*a* and the upper conveyor belt 14*b* is configured capable of being appropriately adjusted automatically or manually according to the length in the conveying direction (cutoff) of the individual sheet. That is, the conveyor mechanism 14 is configured to be capable of handling also so-called variable cutoff where by changing the conveying speed of the lower conveyor belt 14*a* and the upper conveyor belt 14*b* to any speed, the length in the conveying direction (cutoff) of the individual sheet is changed to any cutting length.

The folding cylinder 16 is a cylinder (2 times cylinder) formed in a columnar shape having a circumferential length substantially equal to 2 times the length in the conveying direction of the individual sheet and is provided rotatably along the conveying direction of the individual sheet around a rotating shaft (not illustrated) extending in a direction orthogonal to the conveying direction of the individual sheet and parallel to a planar surface of the individual sheet. In addition, the folding cylinder 16 comprises: two paper edge holding mechanisms 16*a* provided with a spacing of 180° in a circumferential direction; and two thrust blade mechanisms 16*b* similarly provided with a spacing of 180° in a circumferential direction.

The paper edge holding mechanism 16*a* comprises: a plurality of paper holding pins capable of being stabbed into a front edge portion in the conveying direction of the individual sheet; a holder that holds the paper holding pin; a support shaft to which the holder is attached; and an angular displacement means (not illustrated) capable of causing back-and-forth angular displacement (that is, axial rotation in a positive direction and then axial rotation in a reverse direction) of the support shaft at any timing. The paper edge holding mechanism 16*a* is configured to cause back-and-forth angular displacement of the support shaft at any timing by the angular displacement means and thereby project (advance) or retract (withdraw) the paper holding pin from the circumferential surface of the folding cylinder 16, and hold at any timing and release at any timing the front edge portion in the conveying direction of the individual sheet conveyed from the conveyor mechanism 14.

Employable as the angular displacement means is, for example, a cam mechanism comprising: a drive cam having on its circumferential surface a retraction region enabling the paper holding pin to be retracted from the circumferential surface of the folding cylinder 16; a masking cam having on its circumferential surface a mask portion enabling the paper holding pin to be projected from the circumferential surface of the folding cylinder 16 by disabling the retraction region of the drive cam; a masking cam drive means that causes angular displacement of the masking cam around a shaft center between a masking position and a non-masking position at any timing; a drive cam-dedicated cam follower that is connected to the support shaft and moves along a circumferential surface of the drive cam; and a masking cam-dedicated cam follower that is connected to the support shaft and moves along a circumferential surface of the masking cam. This cam mechanism is configured to retract the paper holding pin from the circumferential surface of the folding cylinder 16 in a state where the masking cam is positioned in the non-masking position and project the paper holding pin from the circumferential surface of the folding cylinder 16 to hold the individual sheet in a state where the masking cam is positioned in the masking position. Note that the angular displacement means is not limited to said cam mechanism, and a variety of publicly known angular displacement means may be employed.

The thrust blade mechanisms 16*b* are respectively provided at intermediate positions of the two paper edge holding mechanisms 16*a* and are configured to cause substantially the center in the conveying direction of the one individual sheet or individual sheet group configured from two or more individual sheets held by the paper edge holding mechanism 16*a* to be gripped by a jaw mechanism 18*a* of the jaw cylinder 18 by projecting a thrust blade every time the thrust blade mechanism 16*b* reaches a position where a distance between the thrust blade mechanism 16*b* of the folding cylinder 16 and the jaw mechanism 18*a* of the jaw cylinder 18 is a minimum or every arbitrary number of times the thrust blade mechanism 16*b* reaches said position. Specifically, the thrust blade mechanisms 16*b* each comprise: the thrust blade attached to a support shaft provided parallel to a shaft center of the folding cylinder 16; and an angular displacement means (not illustrated) capable of causing back-and-forth angular displacement (that is, axial rotation in a positive direction and then axial rotation in a reverse direction) of this support shaft at any timing. The thrust blade is formed in a blade shape capable of thrusting substantially the center in the conveying direction of the individual sheet or individual sheet group outwardly in a radial direction and is configured to oscillate around the support shaft in a direction orthogonal to the circumferential surface of the folding cylinder 16 and project (advance) or retract (withdraw) a tip thereof from the circumferential surface of the folding cylinder 16, based on back-and-forth angular displacement of the support shaft. Note that, for example, a cam mechanism may be employed as the angular displacement means similarly to in the paper edge holding mechanism 16*a*, but the angular displacement means is not limited to said cam mechanism, and a variety of publicly known angular displacement means may be employed.

The jaw cylinder 18 is a cylinder (2 times cylinder) formed in a columnar shape having a circumferential length equal to a circumferential length of the folding cylinder 16 and is configured to rotate around a rotating shaft (not illustrated) parallel to that of the folding cylinder 16 in a reverse direction to a rotating direction of the folding cylinder 16. Moreover, the jaw cylinder 18 comprises the two jaw mechanisms 18*a* provided with a spacing of 180° in a circumferential direction.

The jaw mechanisms 18*a* are respectively provided at positions corresponding to the thrust blade mechanisms 16*b* of the folding cylinder 16 and are configured to receive the thrust blade when the distance between the thrust blade mechanism 16*b* of the folding cylinder 16 and the jaw mechanism 18*a* of the jaw cylinder 18 is a minimum and the thrust blade mechanism 16*b* is operated. Specifically, the jaw mechanisms 18*a* each comprise: a jaw blade attached to a support shaft provided parallel to a shaft center of the jaw cylinder 18; and an angular displacement means (not illustrated) capable of causing back-and-forth angular displacement (that is, axial rotation in a positive direction and then axial rotation in a reverse direction) of this support shaft at any timing. The jaw blade is configured to move rotationally along the circumferential direction of the jaw cylinder 18 around the support shaft, grip substantially the center in the conveying direction of the individual sheet or individual sheet group thrust out by the thrust blade of the thrust blade mechanism 16*b* of the folding cylinder 16 and fold in two said individual sheet or individual sheet group to form the signature, based on back-and-forth angular displacement of the support shaft. Note that, for example, a cam mechanism may be employed as the angular displacement means similarly to in the paper edge holding mechanism 16*a*, but the angular displacement means is not limited to said cam mechanism, and a variety of publicly known angular displacement means may be employed.

Circumferential speeds of the folding cylinder 16 and the jaw cylinder 18 are preset or synchronously controlled by a control unit (not illustrated) to be the same speed as the conveying speed in the conveyor mechanism 14. When the circumferential speeds of the folding cylinder 16 and the jaw cylinder 18 and the conveying speed of the conveyor mechanism 14 are set to the same speed in this way, the individual sheet conveyed by the conveyor mechanism 14 can be smoothly wrapped onto the folding cylinder 16, hence it is possible to suppress occurrence of kinks or blockages, and the like.

The folding cylinder 16 and the jaw cylinder 18 (that is, a rotary folding mechanism) comprising the above kinds of configurations make it possible to switch based on a preset composition of the signature to execute: a first signature producing mode (a so-called straight run) that passes the individual sheet wrapped around the folding cylinder 16 by the paper edge holding mechanism 16*a* of the folding cylinder 16 to the jaw mechanism 18*a* of the jaw cylinder 18 every half circumference of the folding cylinder 16; and a second signature producing mode (a so-called collect run) that, every time the folding cylinder 16 is rotated one circumference in a state where the individual sheet wrapped around the folding cylinder 16 by the paper edge holding mechanism 16*a* is held, stacks one following individual sheet on said individual sheet, and that rotates the folding cylinder 16 N circumferences (where N is an integer of 1 or more) and after stacking N individual sheets, passes the N individual sheets to the jaw mechanism 18*a* of the jaw cylinder 18.

Note that the paper edge holding mechanism 16*a*, by for example further comprising the likes of a drive cam-dedicated drive means that causes angular displacement of a drive cam, may be configured to be capable of arbitrarily adjusting a release timing of the individual sheet or individual sheet group based on the length in the conveying direction (cutoff) of the individual sheet. Moreover, the thrust blade mechanism 16*b* may be configured to be capable of having its position in the circumferential direction in the folding cylinder 16 changed based on the length in the conveying direction (cutoff) of the individual sheet. Furthermore, the jaw mechanism 18*a* may be configured to be capable of having its position in the circumferential direction in the jaw cylinder 18 changed based on a phase change of the thrust blade mechanism 16*b*. These paper edge holding mechanism 16*a*, thrust blade mechanism. 16*b*, and jaw mechanism 18*a* make it possible to handle also so-called variable cutoff where the length in the conveying direction of the individual sheet is changed to any length.

Figure 3:
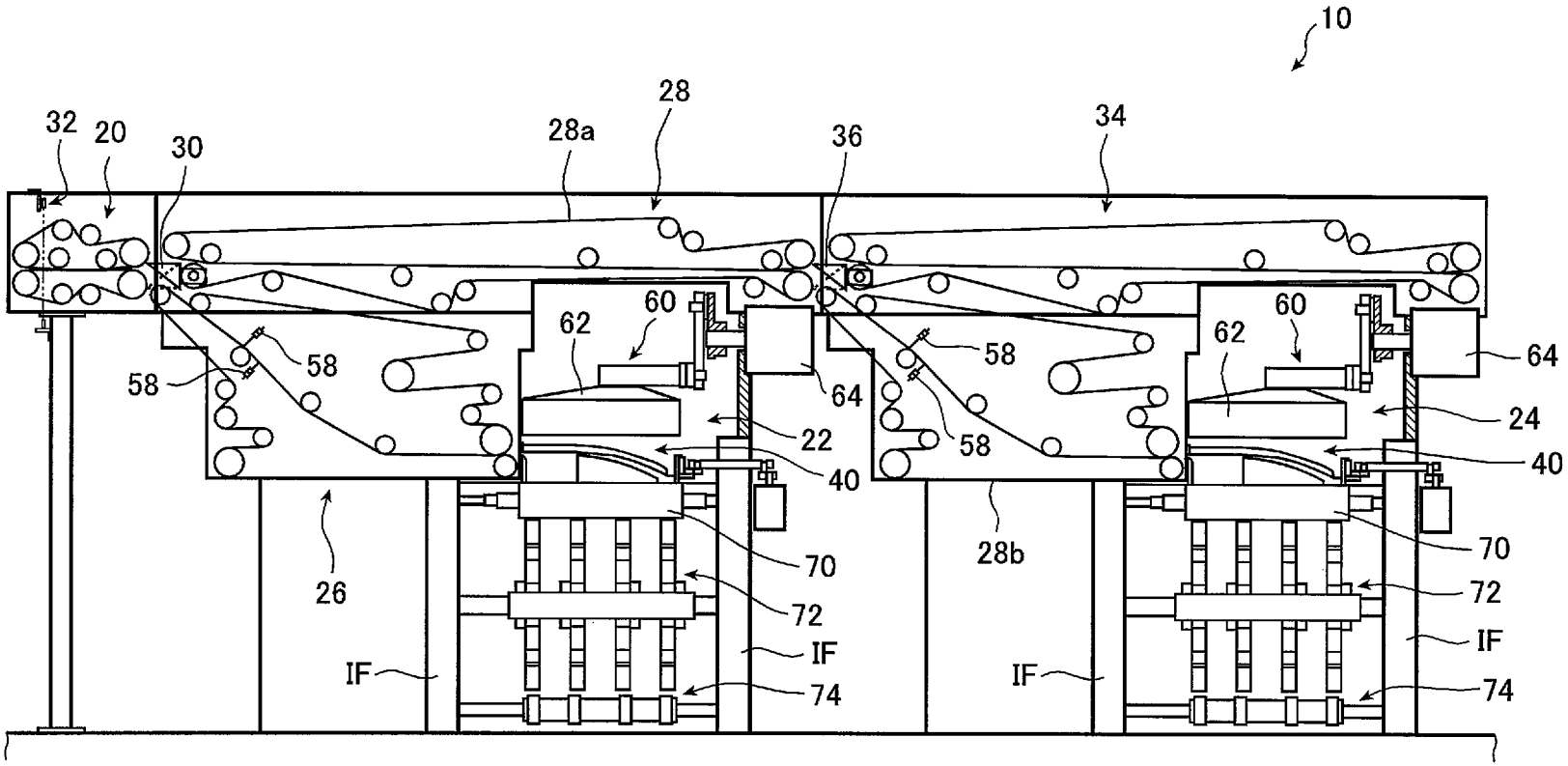
FIG. 3 is a schematic configuration diagram showing an accumulating mechanism according to the present embodiment.

As shown in FIG. 3, the accumulating mechanism 10 comprises: an upstream side conveyor part 20 that conveys a signature received from the jaw cylinder 18 to a downstream side; two accumulating units (a first accumulating unit 22 and a second accumulating unit 24) that are provided aligned with an appropriate spacing in the same direction as a conveying direction of the signature, and that stack one or more signatures therein and fold the one or more signatures in two to form a signature form print product; a distributing and conveying part (a first conveyor part 26, a second conveyor part 28, and a first switching part 30) that is provided between the upstream side conveyor part 20 and the first accumulating unit 22 and second accumulating unit 24, and that distributes (allots) and conveys the signature conveyed by the upstream side conveyor part 20, to each of the first accumulating unit 22 and second accumulating unit 24; and an upstream side sensor 32 that detects the signature conveyed by the upstream side conveyor part 20. In addition, the accumulating mechanism 10 comprises: a third conveyor part 34 that is provided branching from a midway portion of the second conveyor part 28, and that conveys the signature (or an individual sheet) passed on to the second conveyor part 28 from the upstream side conveyor part 20 to a downstream side of the device without conveying the signature (or individual sheet) to the second accumulating unit 24; and a second switching part 36 that switches between a path where the signature (or individual sheet) conveyed by the second conveyor part 28 is conveyed toward the second accumulating unit 24 and a path where the signature (or individual sheet) conveyed by the second conveyor part 28 is conveyed toward the third conveyor part 34.

The upstream side conveyor part 20 is provided close on a downstream side to the jaw cylinder 18, and is configured to convey the signature released by the jaw cylinder 18, sandwiched by an upper belt and a lower belt, and pass the signature to the first conveyor part 26 or the second conveyor part 28. This upstream side conveyor part 20 is controlled by a control unit (not illustrated) to drive at the same speed as the circumferential speed of the jaw cylinder 18.

The upstream side sensor 32 is disposed more on an upstream side than the first switching part 30 and is connected by wire or wirelessly to the first switching part 30. This upstream side sensor 32 is configured to output a detection signal to the first switching part 30 every time the upstream side sensor 32 detects a signature conveyed by the upstream side conveyor part 20 (that is, every time a signature conveyed by the upstream side conveyor part 20 passes the upstream side sensor 32).

The distributing and conveying part comprises: the first conveyor part 26 that conveys the signature conveyed from the upstream side conveyor part 20, toward the first accumulating unit 22; the second conveyor part 28 that conveys the signature conveyed from the upstream side conveyor part 20, toward the second accumulating unit 24; and the first switching part 30 that switches between a path where the signature is conveyed from the upstream side conveyor part 20 toward the first conveyor part 26 and a path where the signature is conveyed from the upstream side conveyor part 20 toward the second conveyor part 28.

The first switching part 30 is disposed between the upstream side conveyor part 20 and the first conveyor part 26 and second conveyor part 28, and is configured to switch between the path where the signature is conveyed from the upstream side conveyor part 20 toward the first conveyor part 26 and the path where the signature is conveyed from the upstream side conveyor part 20 toward the second conveyor part 28, every time the first switching part 30 receives the detection signal from the upstream side sensor 32, by a control unit (not illustrated). That is, the first switching part 30 is configured to switch a conveying path of the signature such that signatures are conveyed sequentially one copy at a time to the first conveyor part 26 and the second conveyor part 28. A variety of drive sources may be employed as a drive source operating this first switching part 30, but in order to achieve high speed operation, the drive source is preferably a drive source capable of high speed switching such as a servo-motor, or the like.

The first conveyor part 26 is provided close on a downstream side to the first switching part 30, and is configured to receive the signature distributed by the first switching part 30, from the upstream side conveyor part 20, convey the signature, sandwiched by an upper belt and a lower belt, and carry in (eject) the signature to a later-described sheet accumulating part 40 of the first accumulating unit 22. This first conveyor part 26 is controlled by a control unit (not illustrated) to drive at the same speed as a conveying speed of the upstream side conveyor part 20.

The second conveyor part 28 comprises: an upstream side second conveyor part 28*a* provided close on a downstream side to the first switching part 30; and a downstream side second conveyor part 28*b* provided between the upstream side second conveyor part 28*a* and the second accumulating unit 24. The upstream side second conveyor part 28*a* is configured to receive the signature distributed by the first switching part 30, from the upstream side conveyor part 20, convey the signature, sandwiched by an upper belt and a lower belt, and pass the signature to the downstream side second conveyor part 28*b* or the third conveyor part 34. The downstream side second conveyor part 28*b* is configured to receive the signature distributed by the second switching part 36, from the upstream side second conveyor part 28*a*, convey the signature, sandwiched by an upper belt and a lower belt, and carry in (eject) the signature to a later-described sheet accumulating part 40 of the second accumulating unit 24. These upstream side second conveyor part 28*a* and downstream side second conveyor part 28*b* are controlled by a control unit (not illustrated) to drive at the same speed as the conveying speed of the upstream side conveyor part 20.

The second switching part 36 is disposed between the upstream side second conveyor part 28*a* and the downstream side second conveyor part 28*b* and third conveyor part 34, and is configured to specify a path such that the signature is conveyed to either one of a path where the signature is conveyed from the upstream side second conveyor part 28*a* toward the downstream side second conveyor part 28*b* and a path where the signature is conveyed from the upstream side second conveyor part 28*a* toward the third conveyor part 34, based on a preset composition of the print product. That is, the second switching part 36 is configured to, when a mode that accumulates the signatures in the second accumulating unit 24 to produce the print product is pre-determined, always specify the path such that all of the signatures conveyed from the upstream side second conveyor part 28*a* are conveyed toward the downstream side second conveyor part 28*b*, and, when a mode that makes the signatures produced by the folding device 8 into a print product (for example, a tabloid size print product) without accumulating the signatures is pre-determined, always specify the path such that all of the signatures conveyed from the upstream side second conveyor part 28*a* are conveyed toward the third conveyor part 34. A variety of drive sources such as an air cylinder or a servo-motor, for example, may be employed as a drive source operating this second switching part 36. Note that when the mode that makes the signatures produced by the folding device 8 into a print product (for example, a tabloid size print product) without accumulating the signatures is pre-determined, the first switching part 30 also always specifies the path such that all of the signatures conveyed from the upstream side conveyor part 20 are conveyed toward the second conveyor part 28, similarly to the second switching part 36.

The third conveyor part 34 is provided close on a downstream side to the second switching part 36, and is configured to receive from the upstream side second conveyor part 28*a* the signature conveyed to the third conveyor part 34 by having its path specified by the second switching part 36, convey the signature, sandwiched by an upper belt and a lower belt, and convey the signature to a downstream process of the present device such as a tabloid fan, for example. This third conveyor part 34 is controlled by a control unit (not illustrated) to drive at the same speed as a conveying speed of the upstream side second conveyor part 28*a*, or greater.

As shown in FIG. 3, the first accumulating unit 22 comprises: the sheet accumulating part 40 that accumulates the signature carried in (ejected) from the first conveyor part 26 and forms the sheet stacked body configured from one or a plurality of signatures; a downstream side sensor 58 that is provided on an upstream side of the sheet accumulating part 40 and that detects the signature conveyed toward the sheet accumulating part 40; a chopper folding mechanism 60 that is provided above a region of the sheet accumulating part 40 where the sheet stacked body is accumulated (a later-described accumulating space 50) and that folds in two the sheet stacked body accumulated in the sheet accumulating part 40; a pair of folding rollers 70 that are provided close to a lower portion of the sheet accumulating part 40 and that sandwich the sheet stacked body folded in two by the chopper folding mechanism 60 to convey the sheet stacked body to a lower portion thereby making a crease in the sheet stacked body and forming the signature form print product; a delivery fan 72 that is provided at a lower portion of the pair of folding rollers 70 and that receives the signature form print product discharged from the pair of folding rollers 70 to convey the signature form print product to a downstream side; and a delivery conveyor 74 that is provided at a lower portion of the delivery fan 72 and that conveys the signature form print product received from the delivery fan 72 to outside of the accumulating mechanism 10 (for example, to a collection box, or the like). Note that in the accumulating units 22 and 24 according to the present embodiment, a variety of publicly known a pair of folding rollers, delivery fans, and delivery conveyors may be employed as the pair of folding rollers 70, the delivery fan 72, and the delivery conveyor 74, hence descriptions thereof will be omitted. Moreover, the second accumulating unit 24 comprises a similar configuration to that of the first accumulating unit 22, hence identical reference symbols are employed therein and a description thereof will be omitted.

Figure 5:
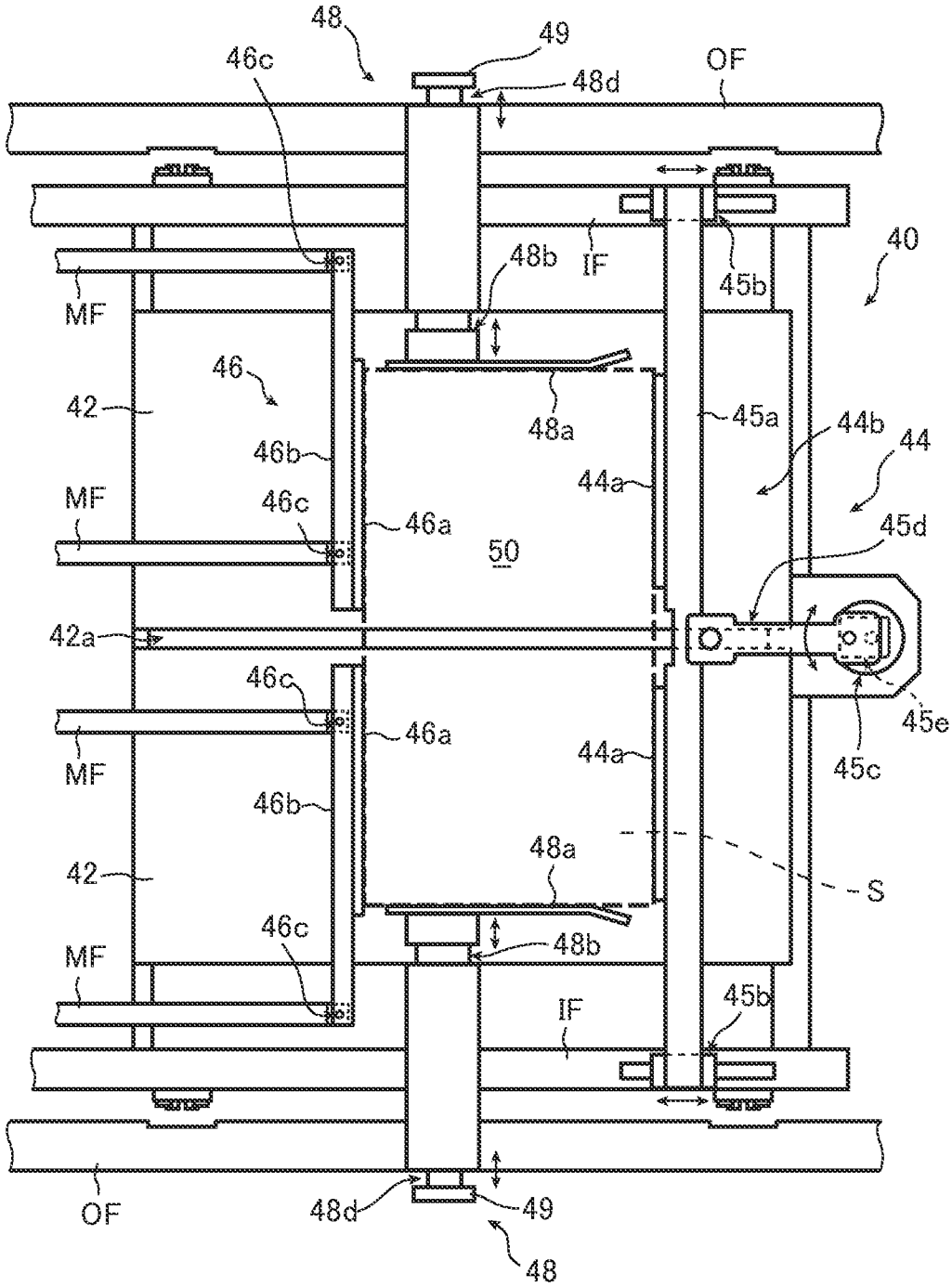
FIG. 5 is a schematic configuration diagram showing a state where the sheet accumulating part according to the present embodiment is viewed from a planar direction (above).

As shown in FIGS. 3 and 5, a later-described table 42 and front positioning mechanism 44 of the sheet accumulating part 40, the chopper folding mechanism 60, the pair of folding rollers 70, the delivery fan 72, and the delivery conveyor 74 are supported by a device inner frame IF provided between a pair of device outer frames OF. The device inner frame IF is a frame body comprising a pedestal portion capable of having the table 42 mounted thereon and leg portions that support the pedestal portion, the leg portions being supported by a pair of linear motion guides (not illustrated) bridged between the pair of device outer frames OF. Moreover, the device inner frame IF is connected to one of the device outer frames OF via a folding line width adjustment mechanism (not illustrated). The folding line width adjustment mechanism (not illustrated) includes a thread-cut portion penetrating part of the device inner frame IF and one of the device outer frames OF, and is configured to move the device inner frame IF along the linear motion guides (not illustrated) in a width direction of the signature S, by automatically or manually rotating the thread-cut portion in a positive direction or a reverse direction.

Figure 10:
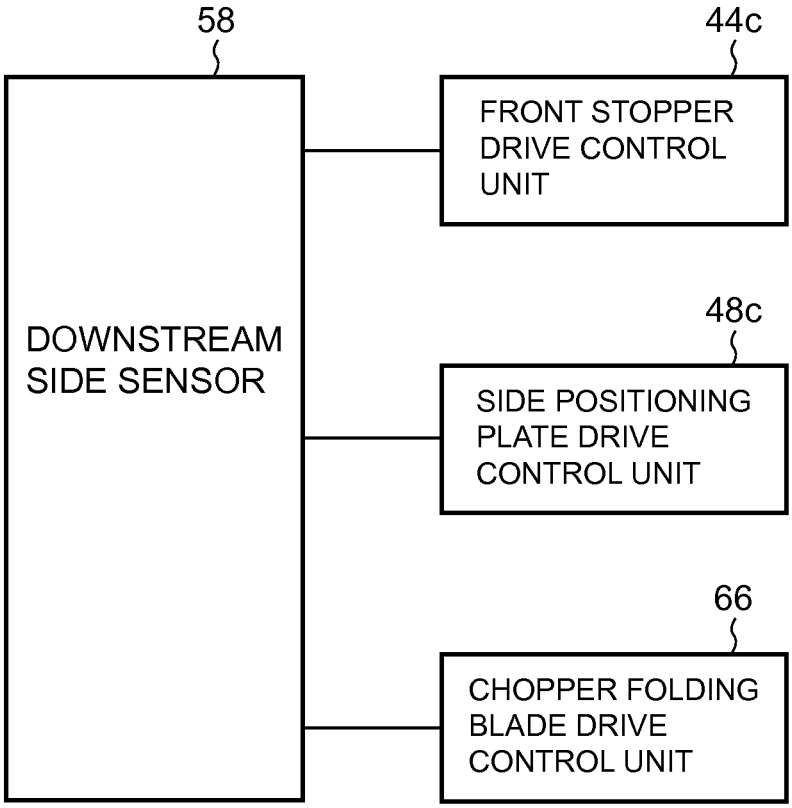
FIG. 10 is a block diagram showing a downstream side sensor, a front stopper drive control unit, a side positioning plate drive control unit, and a chopper folding blade drive control unit according to the present embodiment.

As shown in FIGS. 3 and 10, the downstream side sensor 58 is disposed on the conveying path of the first conveyor part 26 (downstream side second conveyor part 28*b* in the case of the second accumulating unit 24) and is connected by wire or wirelessly to a later-described front stopper drive control unit 44*c* and side positioning plate drive control unit 48*c* of the sheet accumulating part 40 and to a chopper folding blade drive control unit 66. This downstream side sensor 58 is configured to output a detection signal to the later-described front stopper drive control unit 44*c* and side positioning plate drive control unit 48*c* of the sheet accumulating part 40 and to the chopper folding blade drive control unit 66 every time the downstream side sensor 58 detects a signature conveyed by the first conveyor part 26 (downstream side second conveyor part 28*b*), that is, every time a signature conveyed by the first conveyor part 26 (downstream side second conveyor part 28*b*) passes the downstream side sensor 58. Note that in the accumulating units 22 and 24 according to the present embodiment, a pair of downstream side sensors 58 are provided in order to achieve reliable detection, but the present invention is not limited to this configuration, and there may be one downstream side sensor 58 only.

Figure 4:
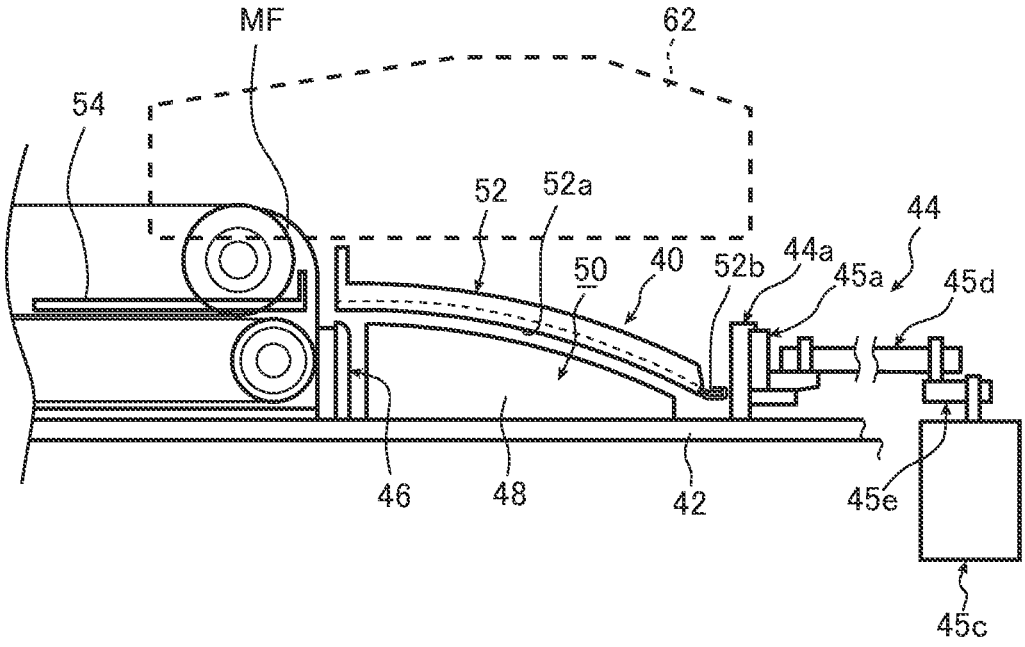
FIG. 4 is a schematic configuration diagram showing a state where a sheet accumulating part according to the present embodiment is viewed from a front direction (a width direction of accumulated sheets).

As shown in FIGS. 4 and 5, the sheet accumulating part 40 comprises: the table 42 on which the signature S carried in (ejected) to the sheet accumulating part 40 from the first conveyor part 26 (downstream side second conveyor part 28*b*) is accumulated; a front positioning mechanism 44 (front positioning part) provided on a front side in a carrying-in direction of the carried-in signature S; a rear positioning mechanism 46 (rear positioning part) provided on a rear side in the carrying-in direction of the carried-in signature S; and a pair of left and right side positioning mechanisms 48 (side positioning parts) respectively provided on both sides of the carried-in signature. Moreover, the sheet accumulating part 40 is configured such that the accumulating space 50 whose four sides and underside are surrounded is formed by these table 42, front positioning mechanism 44, rear positioning mechanism 46, and pair of left and right side positioning mechanisms 48. In addition, the sheet accumulating part 40 further comprises: a paper guide 52 that is provided above an accumulating position between the front positioning mechanism 44 and the rear positioning mechanism 46 (above the accumulating space 50) and that guides the signature S that has entered the sheet accumulating part 40 to the accumulating position by a lower surface of the paper guide 52; and an auxiliary guide 54 provided more on an upstream side than the paper guide 52.

Note that in the description of the present embodiment, a carrying-in direction refers to that direction of the directions parallel to an upper surface of the table 42 that conforms to a direction in which the signature S carried in to the accumulating space 50 from the first conveyor part 26 (downstream side second conveyor part 28*b*) advances or a reverse direction of this, that is, a direction directed from one to the other of a later-described front stopper 44*a* and rear positioning plate 46*a* (left and right direction in FIG. 5). Moreover, a width direction refers to that direction of the directions parallel to the upper surface of the table 42 that conforms to a paper width direction of the signature S accumulated in the accumulating space 50, that is, a direction directed from one to the other of a later-described pair of side positioning plates 48*a* (up and down direction in FIG. 5). FIG. 4 is a schematic configuration diagram showing a state where the sheet accumulating part 40 is viewed from the width direction, and FIG. 5 is a schematic configuration diagram showing a state where the sheet accumulating part 40 is viewed from a planar direction (above).

As shown in FIG. 5, the table 42 is a plate-like member functioning as a base on which the signature S is stacked, and is mounted on the pedestal portion of the device inner frame IF. This table 42 is divided in two at substantially its center in the width direction such that a gap (groove) 42*a* into which a later-described chopper folding blade 62 can pass is formed at substantially the center in the width direction of the signature S in the accumulating space 50. An upper surface of the table 42 (a surface on which the signature S is stacked) is chrome plating processed.

As shown in FIGS. 4 and 5, the front positioning mechanism 44 comprises: the movable front stopper 44*a* that is provided on the front side in the carrying-in direction of the signature S carried into the accumulating space 50 (that is, on a side facing an ejection hole of the first conveyor part 26 or downstream side second conveyor part 28*b*) and that positions a front edge in the carrying-in direction of the signature S; a front stopper drive unit 44*b* that moves the front stopper 44*a* back-and-forth in a direction of moving closer to or moving away from the rear positioning mechanism 46; and the front stopper drive control unit 44*c* that operates the front stopper drive unit 44*b*.

The front stopper 44*a* is a plate-like member of iron disposed upright facing the ejection hole of the first conveyor part 26 (downstream side second conveyor part 28*b*), and a pair of the front stoppers 44*a* are provided in the width direction of the signature S, bounded by the gap 42*a* of the table 42, with a spacing of a width of the gap 42*a* or more. These pair of front stoppers 44*a* have their surface on the side facing the ejection hole of the first conveyor part 26 (downstream side second conveyor part 28*b*) formed as a smooth surface conforming to the front edge in the carrying-in direction of the signature S, and are configured to be capable of performing positioning (paper alignment) of the front edge in the carrying-in direction of the signature S by this smooth surface.

The front stopper drive unit 44*b* comprises: a support bar 45*a* that supports the pair of front stoppers 44*a*; a linear motion guide 45*b* provided at both ends of the support bar 45*a*; an arm 45*d* that transmits power of a drive source 45*c* to the support bar 45*a* and moves the support bar 45*a* back-and-forth in the direction of moving closer to or moving away from the rear positioning mechanism 46; and a crank 45*e* having its one end coupled to the arm 45*d* and its other end coupled to an output shaft of the drive source 45*c*.

The support bar 45*a* is an elongated member bridged to traverse the accumulating space 50 in the width direction of the signature S, and is slidably supported by the pedestal portion of the device inner frame IF via the linear motion guide 45*b*. The pair of front stoppers 44*a* are attached to a surface of the support bar 45*a* on the side facing the ejection hole of the first conveyor part 26 (downstream side second conveyor part 28*b*). The arm 45*d* is coupled to substantially the center in a longer direction of the support bar 45*a*.

The linear motion guide 45*b* is configured from: a pair of linear rails attached along the carrying-in direction of the signature S on the pedestal portion of the device inner frame IF; and slide members that are respectively attached to both ends of the support bar 45*a* and that slide over each of the rails. Note that a variety of publicly known mechanisms guiding back-and-forth movement of the support bar 45*a* may be employed besides the linear motion guide 45*b*.

The arm 45*d* has its one end coupled to the support bar 45*a* and its other end coupled to the crank 45*e*. The arm 45*d* and the crank 45*e* are configured such that rotary motion from the drive source 45*c* is converted to linear motion to be transmitted to the support bar 45*a*. Note that a variety of publicly known mechanisms moving the support bar 45*a* back-and-forth may be employed besides the crank mechanism of the kind in the present embodiment. Moreover, a variety of drive sources may be employed as the drive source 45*c*, but in order to achieve high speed operation, the drive source is preferably a drive source capable of high speed switching such as a servo-motor, or the like.

As shown in FIG. 10, the front stopper drive control unit 44*c* is connected to the downstream side sensor 58 and is configured to, every time the front stopper drive control unit 44*c* receives a detection signal from the downstream side sensor 58, operate the front stopper drive unit 44*b* at an appropriate timing and move the front stopper 44*a* back-and-forth along the carrying-in direction of the signature S. Specifically, the front stopper drive control unit 44*c* operates the front stopper drive unit 44*b* to, every time the front stopper drive control unit 44*c* receives a detection signal from the downstream side sensor 58, move the front stopper 44*a* away from the rear positioning plate 46*a* at an appropriate timing immediately before the signature S carried in to the accumulating space 50 contacts the front stopper 44*a*, such that a distance of the front stopper 44*a* from the rear positioning plate 46*a* of the rear positioning mechanism 46 is larger than the length in the conveying direction of the signature S. Moreover, the front stopper drive control unit 44*c* operates the front stopper drive unit 44*b* to move the front stopper 44*a* closer to the rear positioning plate 46*a* at an appropriate timing immediately after the front edge in the carrying-in direction of the signature S has contacted the stopper 44*a* that has been moved away from the rear positioning plate 46*a*, such that the distance of the front stopper 44*a* from the rear positioning plate 46*a* of the rear positioning mechanism 46 is substantially equal to the length in the conveying direction of the signature S. Note that a time from receiving the detection signal from the downstream side sensor 58 to operating the front stopper drive unit 44*b* (a time lag) can be specified based on the conveying speed of the signature S by the first conveyor part 26 (downstream side second conveyor part 28*b*) or a distance from the downstream side sensor 58 to the sheet accumulating part 40, and so on.

Figure 6:
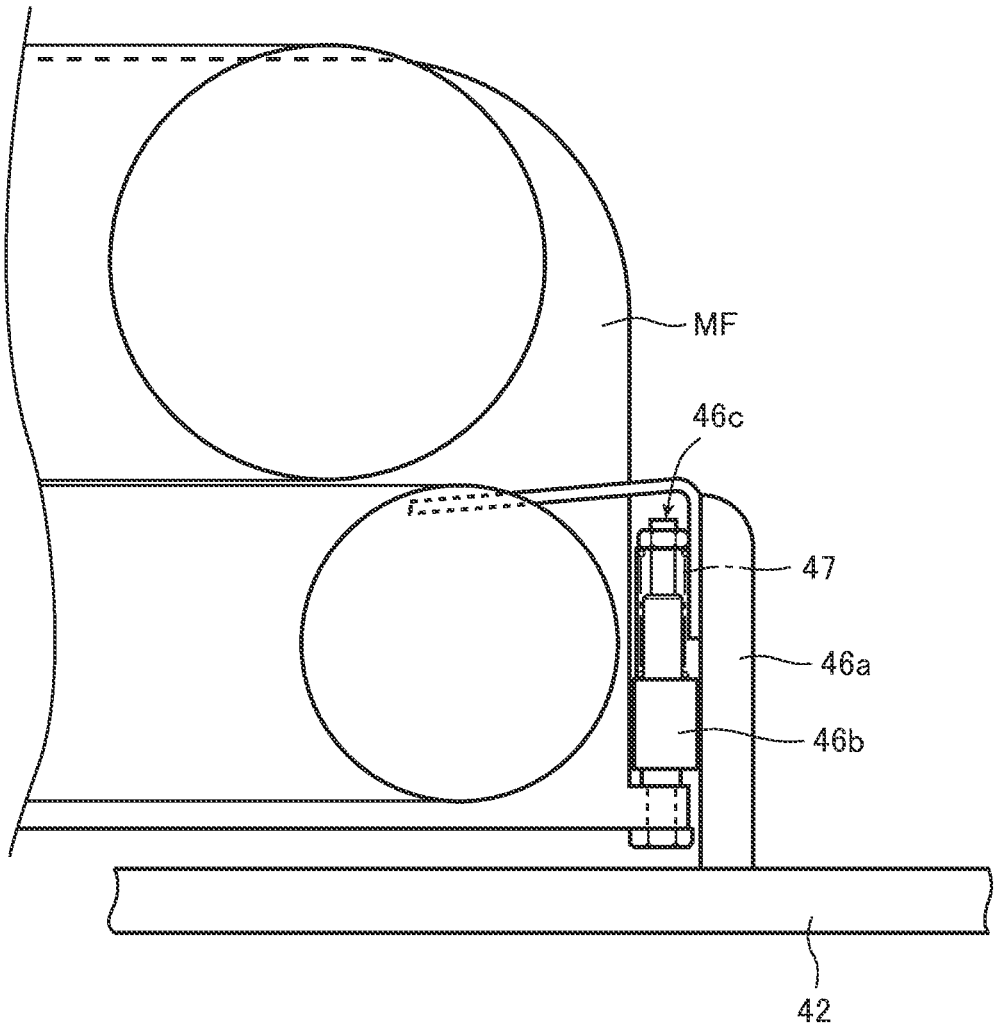
FIG. 6 is a partially cut out schematic configuration diagram showing a rear positioning mechanism according to the present embodiment.

As shown in FIGS. 5 and 6, the rear positioning mechanism 46 comprises: the rear positioning plate 46*a* that is provided facing the front stopper 44*a* on a rear side in the carrying-in direction of the signature S carried into the accumulating space 50 (that is, close to the ejection hole of the first conveyor part 26 or downstream side second conveyor part 28*b*) and that serves as a reference when performing paper alignment in the carrying-in direction of the signature S by the front positioning mechanism 44; a support bar 46*b* that supports the rear positioning plate 46*a*; and a bias mechanism 46*c* that presses the rear positioning plate 46*a* onto the table 42 by biasing the support bar 46*b* toward the table 42.

The rear positioning plate 46*a* is a plate-like member disposed upright facing the front stopper 44*a* close to the ejection hole of the first conveyor part 26 (downstream side second conveyor part 28*b*), and a pair of the rear positioning plates 46*a* are provided in the width direction of the signature S, bounded by the gap 42*a* of the table 42, with a spacing of the width of the gap 42*a* or more. These pair of rear positioning plates 46*a* have their surface on a side facing the front stopper 44*a* formed as a smooth surface conforming to a rear edge in the carrying-in direction of the signature S, and are configured to enable positioning (paper alignment) of the rear edge in the carrying-in direction of the signature S by this smooth surface. The rear positioning plate 46*a* may be formed from any material, but is preferably formed from a soft resin material in order to prevent damage of the table 42.

The support bar 46*b* is an elongated member attached to a movable frame MF via the bias mechanism 46*c*, and a pair of the support bars 46*b* are provided to traverse in the width direction of the signature S in a region excluding the gap 42*a* of the table 42. The rear positioning plates 46*a* are respectively attached to a surface of each of the support bars 46*b* on a side facing the front stopper 44*a*. The movable frame MF is a plate-like frame member disposed upright along the carrying-in direction of the signature S between the pair of device outer frames OF, and is configured to be capable of moving along the carrying-in direction of the signature S by a moving mechanism (not illustrated). Each of configurative elements such as belts and pulleys configuring the first conveyor part (downstream side second conveyor part 28*b*), the rear positioning mechanism 46, and so on, are attached to this movable frame MF.

As shown in FIG. 6, the bias mechanism 46*c* is fixed to the movable frame MF, and is configured to bias the support bar 46*b* and the rear positioning plate 46*a* fixed to this support bar 46*b* toward the table 42, by a coil spring 47 housed internally. As shown in FIG. 5, two each of these movable frames MF and bias mechanisms 46*c* are respectively disposed to each of the support bars 46*b*.

The rear positioning mechanism 46 according to the present embodiment is configured to be capable of appropriately adjusting a distance between the front stopper 44*a* and the rear positioning plate 46*a*, that is, a position of the rear positioning plate 46*a* acting as a reference when performing paper alignment, by moving the movable frame MF along the carrying-in direction of the signature S based on the length in the conveying direction of the signature S. Such a rear positioning mechanism 46 makes it possible to handle also so-called variable cutoff where the length in the conveying direction of the individual sheet is changed to any length.

As shown in FIG. 5, the pair of left and right side positioning mechanisms 48 each comprise: a movable side positioning plate 48*a* that positions one of side edges in the width direction of the signature S carried into the accumulating space 50; a side positioning plate drive unit 48*b* that moves the side positioning plate 48*a* back-and-forth along the width direction of the signature S; the side positioning plate drive control unit 48*c* that operates the side positioning plate drive unit 48*b*; and a reference position adjustment mechanism 48*d* that moves the side positioning plate 48*a* and the side positioning plate drive unit 48*b* in an integrated manner along the width direction of the signature S and adjusts a reference position of the side positioning plate 48*a*.

As shown in FIG. 5, these pair of left and right side positioning mechanisms 48 are supported by the pair of device outer frames OF separated in the width direction of the signature S, such that the side positioning plates 48*a* face each other. Specifically, the reference position adjustment mechanism 48*d* of one of the side positioning mechanisms 48 is supported by one of the device outer frames OF, and the reference position adjustment mechanism 48*d* of the other of the side positioning mechanisms 48 is supported by the other of the device outer frames OF. These pair of left and right side positioning mechanisms 48 are position adjusted by the reference position adjustment mechanism 48*d* such that in a position (paper alignment position) where each of the side positioning plates 48*a* are most inwardly advanced in the width direction of the signature S by each of the side positioning plate drive units 48*b*, a distance between one of the side positioning plates 48*a* and the other of the side positioning plates 48*a* is substantially equal to a length in the width direction of the signature S.

The side positioning plate 48*a* is a plate-like member of resin having a length in a longer direction which is shorter than the distance from the rear positioning plate 46*a* to the front stopper 44*a*, and is disposed upright such that its longer direction is parallel to the carrying-in direction of the signature S and its surface faces a surface of the side positioning plate 48*a* of the other of the side positioning mechanisms 48. This side positioning plate 48*a* has its surface on a side facing the side positioning plate 48*a* of the other of the side positioning mechanisms 48 formed as a smooth surface conforming to one of the side edges of the signature S, and is configured to be capable of cooperating with the side positioning plate 48*a* of the other of the side positioning mechanisms 48 to perform positioning (paper alignment) of the side edge of the signature S by this smooth surface. The side positioning plate 48*a* may be formed from any material, but in order to make the accumulating space 50 viewable, the side positioning plate 48*a* is preferably formed from a transparent resin material such as a transparent polycarbonate, or the like.

The side positioning plate drive unit 48*b* is configured to support the side positioning plate 48*a* in such a barely suspended state as to prevent a gap sufficient for the signature S to enter between a lower end of the side positioning plate 48*a* and the upper surface of the table 42 from being formed, and is configured to move the side positioning plate

48*a* along the width direction of the signature S by an appropriate drive means such as an air cylinder. A variety of publicly known mechanisms and drive sources may be employed as the mechanism and drive source moving such a side positioning plate 48*a* back-and-forth, hence descriptions thereof will be omitted.

As shown in FIG. 10, the side positioning plate drive control unit 48*c* is connected to the downstream side sensor 58 and is configured to, every time the side positioning plate drive control unit 48*c* receives a detection signal from the downstream side sensor 58, operate the side positioning plate drive unit 48*b* at an appropriate timing and move the side positioning plate 48*a* back-and-forth along the width direction of the signature S. Specifically, the side positioning plate drive control unit 48*c* operates the side positioning plate drive unit 48*b* to, every time the side positioning plate drive control unit 48*c* receives a detection signal from the downstream side sensor 58, move the side positioning plate 48*a* closer to the side positioning plate 48*a* of the other of the side positioning mechanisms 48 (advance the side positioning plate 48*a* inwardly in the width direction) at an appropriate timing when the signature S carried in to the accumulating space 50 is accumulated on the table 42 (preferably, after the signature S has been accumulated on the table 42), such that a distance of the side positioning plate 48*a* from the side positioning plate 48*a* of the other of the side positioning mechanisms 48 is substantially equal to the length in the width direction of the signature S. Moreover, in preparation for accumulation of the next signature S, the side positioning plate drive control unit 48*c* operates the side positioning plate drive unit 48*b* to move the side positioning plate 48*a* away from the side positioning plate 48*a* of the other of the side positioning mechanisms 48 (withdraw the side positioning plate 48*a* outwardly in the width direction) such that the distance of the side positioning plate 48*a* from the side positioning plate 48*a* of the other of the side positioning mechanisms 48 is larger than the length in the width direction of the signature S. Note that a time from receiving the detection signal from the downstream side sensor 58 to operating the side positioning plate drive unit 48*b* (a time lag) can be specified based on the conveying speed of the signature S by the first conveyor part 26 (downstream side second conveyor part 28*b*) or a distance from the downstream side sensor 58 to the sheet accumulating part 40, and so on.

The reference position adjustment mechanism 48*d* has an appropriate moving means such as a ball screw mechanism, or the like, built in internally thereto, and is configured to move the side positioning plate 48*a* and the side positioning plate drive unit 48*b* back-and-forth along the width direction of the signature S in an integrated manner, by rotating an adjustment handle 49 positively and reversely. This reference position adjustment mechanism 48*d* makes it possible to move the entire side positioning mechanism 48 in the width direction of the signature S in order to adjust the reference position (paper alignment position) of the side positioning plate 48*a* according to a change in paper width of the continuous paper W. Note that a variety of publicly known mechanisms may be employed as a mechanism for adjusting the reference position of such a side positioning plate 48*a*, hence a description thereof will be omitted. Moreover, a configuration may be adopted where the reference position adjustment mechanism 48*d* is controlled automatically according to a change in paper width of the continuous paper W, and not by manual operation.

Figure 7:
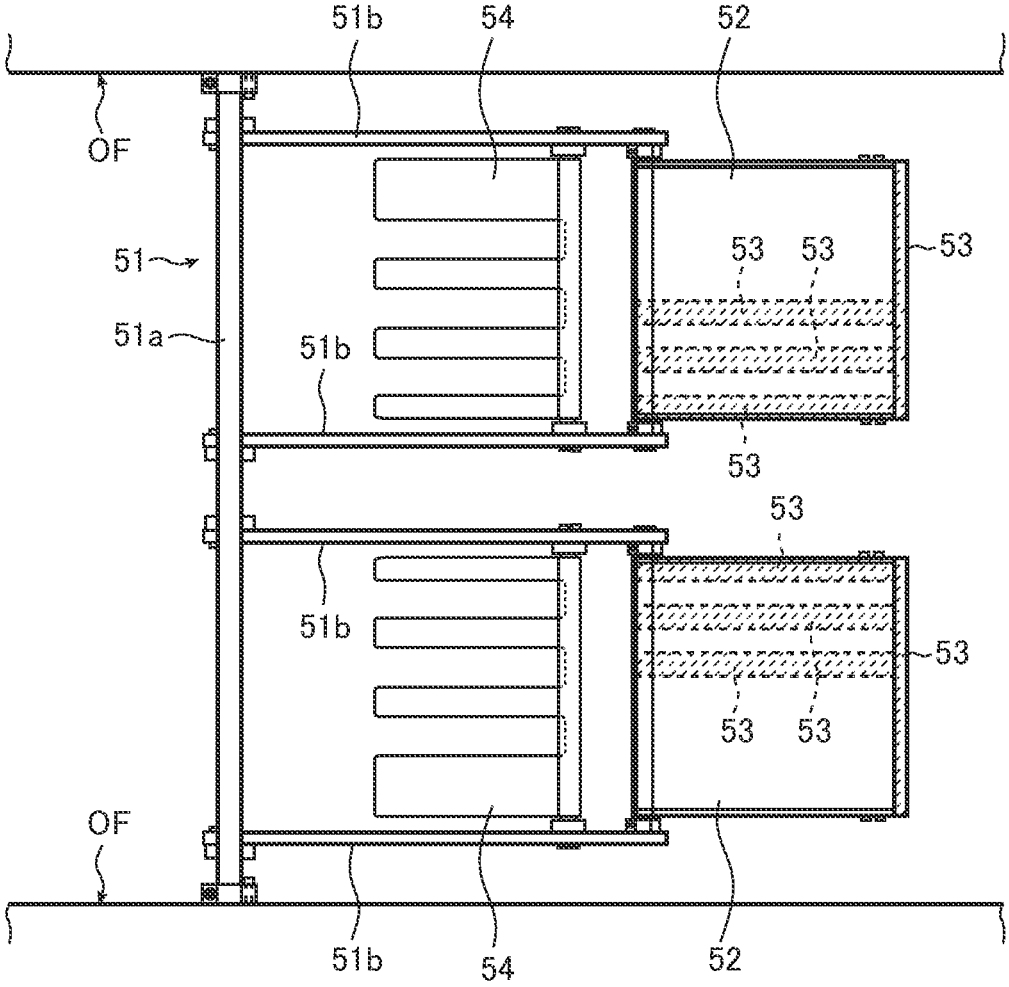
FIG. 7 is a schematic configuration diagram showing a state where a paper guide according to the present embodiment is viewed from a planar direction (above).

As shown in FIGS. 4 and 7, the paper guide 52 is a plate-like member having a size capable of covering a half side region of the accumulating space 50 in the case that the table 42 is bounded by the gap 42*a*, that is, a length in the carrying-in direction from close above the ejection hole of the first conveyor part 26 (downstream side second conveyor part 28*b*) to close to a lower end of the smooth surface of the front stopper 44*a*, and a length in the width direction substantially equal to the length in the width direction of one of the divided-in-two portions of the table 42.

As shown in FIG. 7, two of the paper guides 52 are provided with an appropriate spacing allowing the chopper folding blade 62 to pass, and the paper guides 52 are supported by a paper guide support mechanism 51 provided immovably between the pair of device outer frames OF. The paper guide support mechanism 51 comprises: a support shaft 51*a* bridged between the pair of device outer frames OF; and two pairs of (four) brackets 51*b* provided with a certain spacing along an axial direction of the support shaft 51*a* (that is, the width direction of the signature S). Each of the brackets 51*b* is a plate-like frame member, and is disposed upright along the carrying-in direction of the signature S. As shown in FIG. 4, each of the paper guides 52 is attached between a pair of the brackets 51*b* such that an end on a rear side in the carrying-in direction is positioned close above the ejection hole of the first conveyor part 26 (downstream side second conveyor part 28*b*) and an end on a front side in the carrying-in direction is positioned close to the lower end of the smooth surface of the front stopper 44*a*.

Figure 8:
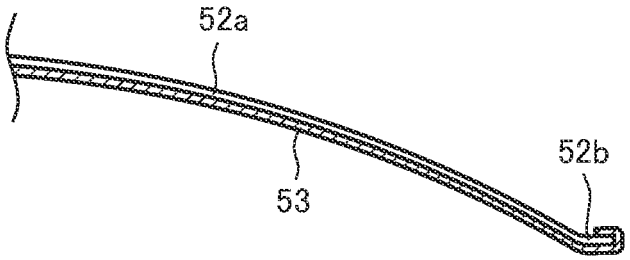
FIG. 8 is an enlarged schematic configuration diagram showing a leading edge portion of the paper guide according to the present embodiment.

As shown in FIGS. 4 and 8, each of the paper guides 52 has a substantially arc-like cross-sectional shape curved from the rear side in the carrying-in direction toward the front side in the carrying-in direction, that is a shape which is gently curved while inclining downward from close above the ejection hole of the first conveyor part 26 (downstream side second conveyor part 28*b*) toward close to the lower end of the smooth surface of the front stopper 44*a*, and each of the paper guides 52 is configured to guide advancement of the signature S such that the signature S carried in from the first conveyor part 26 (downstream side second conveyor part 28*b*) reliably reaches the front stopper 44*a*. More specifically, as shown in FIG. 4, the paper guide 52 includes: a curved inclined portion 52*a* (inclined portion) that is downwardly inclined while curving in an upwardly convex manner from close above the ejection hole of the first conveyor part 26 (downstream side second conveyor part 28*b*) toward the front stopper 44*a*; and a leading edge horizontal portion 52*b* where a leading edge on a front stopper 44*a* side of the curved inclined portion 52*a* is horizontal and formed by being bent in a direction toward close to the lower end of the smooth surface of the front stopper 44*a*, and the paper guide 52 is configured to guide advancement of the signature S from the ejection hole of the first conveyor part 26 (downstream side second conveyor part 28*b*) to close to the lower end of the smooth surface of the front stopper 44*a* by lower surfaces of these curved inclined portion 52*a* and leading edge horizontal portion 52*b*. A position in a height direction of the leading edge horizontal portion 52*b* is appropriately set or adjusted in a range just sufficient for a gap to barely occur between the lower surface of the leading edge horizontal portion 52*b* and an upper surface of the sheet stacked body formed in the accumulating space 50, that is, in a range where no obstacle to stacking of the signature S in the accumulating space 50 occurs.

As shown in FIGS. 7 and 8, the lower surface of each of the paper guides 52, that is, a contact surface with the signature S of each of the paper guides 52 is provided with a frictional resistance increasing member 53 capable of increasing frictional resistance to more than when the signature contacts the lower surface of the paper guide 52 directly, and decreasing momentum (speed) of the signature S discharged (ejected) from the first conveyor part 26 (downstream side second conveyor part 28*b*). This frictional resistance increasing member 53 is formed in a band shape (tape form), three of the frictional resistance increasing members 53 are provided with a certain spacing in the width direction in a region from a rear end in the carrying-in direction to a front end in the carrying-in direction on the lower surface of each of the paper guides 52, and the frictional resistance increasing member 53 is provided along substantially the entire region in the width direction of the front end in the carrying-in direction of the paper guide 52. Moreover, the frictional resistance increasing member 53 preferably further comprises shock-absorbing characteristics capable of easing impact more than when the signature S discharged (ejected) from the first conveyor part 26 (downstream side second conveyor part 28*b*) contacts the lower surface of the paper guide 52 directly. A variety of frictional resistance increasing members may be employed as the frictional resistance increasing member 53. For example, the likes of a tape member provided with flexible superhairs like loop-side fasteners of a hook-and-loop fastener clustered on one surface thereof, may be employed as the frictional resistance increasing member 53.

As shown in FIGS. 4 and 7, the auxiliary guide 54 is a plate-like member provided horizontally close above the conveying path of the first conveyor part 26 (downstream side second conveyor part 28*b*), and two of the auxiliary guides 54 are provided with an appropriate spacing allowing the chopper folding blade 62 to pass, similarly to the paper guides 52. Each of the auxiliary guides 54 is attached between a pair of the brackets 51*b* so as to be positioned on an upstream side of each of the paper guides 52. Moreover, as shown in FIG. 7, each of the auxiliary guides 54 has a comb-like shape in order to prevent interference between the upper belt and lower belt of the first conveyor part 26 (downstream side second conveyor part 28*b*) and pulleys of these upper belt and lower belt.

This auxiliary guide 54 is configured to, when the movable frame MF is moved in a reverse direction to the carrying-in direction of the signature S (left direction in FIG. 4) and a gap has occurred between the ejection hole of the first conveyor part 26 (downstream side second conveyor part 28*b*) and an end on the rear side in the carrying-in direction of the paper guide 52, fill said gap and lead the signature S ejected (discharged) from the ejection hole of the first conveyor part 26 (downstream side second conveyor part 28*b*) to the lower surface of the paper guide 52. That is, when the length in the conveying direction (cutoff) of the individual sheet is lengthened, the length in the conveying direction of the signature S also lengthens accordingly, and the movable frame MF and rear positioning mechanism 46 are moved proportionately in the reverse direction to the carrying-in direction of the signature S (left direction in FIG. 4). Moreover, due to movement of the movable frame MF, the upper belt and lower belt of the first conveyor part 26 (downstream side second conveyor part 28*b*) supported by the movable frame MF are also moved in the reverse direction to the carrying-in direction of the signature S (left direction in FIG. 4), whereby a gap occurs between the ejection hole of the first conveyor part 26 (downstream side second conveyor part 28*b*) and the end on the rear side in the carrying-in direction of the paper guide 52. The auxiliary guide 54 functions to fill the gap that has occurred in this way and guide such that the signature S ejected (discharged) from the ejection hole of the first conveyor part 26 (downstream side second conveyor part 28*b*) reaches the lower surface of the paper guide 52. Such an auxiliary guide 54 makes it possible to handle also so-called variable cutoff where the length in the conveying direction of the individual sheet is changed to any length.

As shown in FIG. 3, the chopper folding mechanism 60 comprises: the chopper folding blade 62 that strikes, from above, substantially a central position in the width direction of the sheet stacked body accumulated in the sheet accumulating part 40 and presses the sheet stacked body into the gap 42*a* of the table 42 in a state of being folded in two (lengthways folding); a chopper folding blade drive unit 64 that moves the chopper folding blade 62 back-and-forth in a direction of moving closer to or moving away from the sheet stacked body accumulated in the sheet accumulating part 40 (that is, an up and down direction); and the chopper folding blade drive control unit 66 that operates the chopper folding blade drive unit 64. Note that in the chopper folding mechanism 60 according to the present embodiment, a variety of publicly known chopper folding blades and chopper folding blade drive units may be employed as the chopper folding blade 62 and the chopper folding blade drive unit 64, hence descriptions thereof will be omitted.

As shown in FIG. 10, the chopper folding blade drive control unit 66 is connected to the downstream side sensor 58, and is configured to count the number of times of the detection signals received from the downstream side sensor 58, that is, the number of copies of the signature S that have passed the downstream side sensor 58 (number of times of passing), operate the chopper folding blade drive unit 64 at an appropriate timing when a predetermined number of copies (any number of one copy or more) of the signature S have finished passing, and move the chopper folding blade 62 back-and-forth in the up and down direction. Note that a time from the predetermined number of copies of the signature S finishing passing the downstream side sensor 58 to operating the chopper folding blade drive unit 64 (a time lag) can be specified based on the conveying speed of the signature S by the first conveyor part 26 (downstream side second conveyor part 28*b*) or a distance from the downstream side sensor 58 to the sheet accumulating part 40, and so on.

Figure 9A:
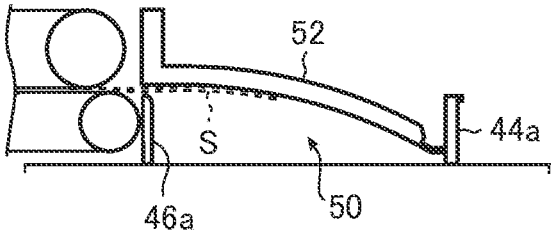
FIG. 9A is a schematic view of the sheet accumulating part in a state where a sheet has begun to enter an accumulating space as seen from a front direction (a width direction of accumulated sheets)
Figure 9B:
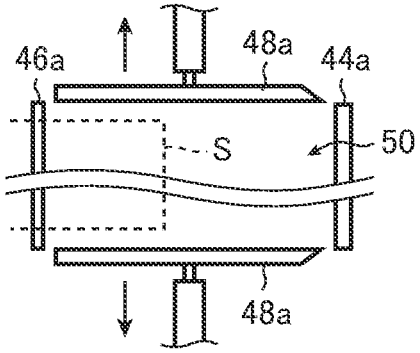
FIG. 9B is a schematic view of the state of FIG. 9A as seen from a planar direction (above).
Figure 9C:
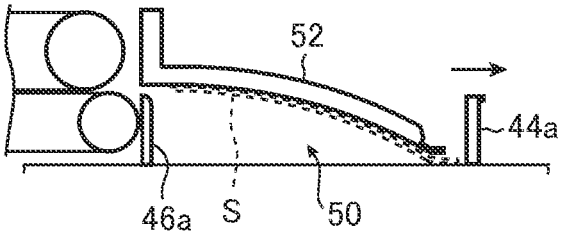
FIG. 9C is a schematic view of the sheet accumulating part in a state immediately before the sheet that has been carried into the accumulating space contacts a front stopper as seen from a front direction.
Figure 9D:
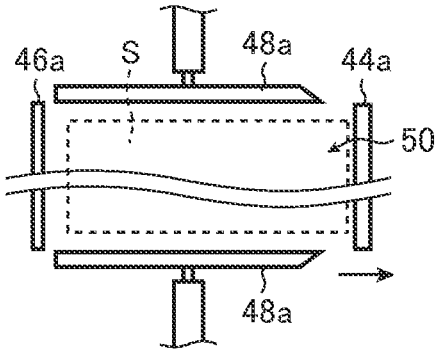
FIG. 9D is a schematic view of the state of FIG. 9C as seen from a planar direction.
Figure 9E:
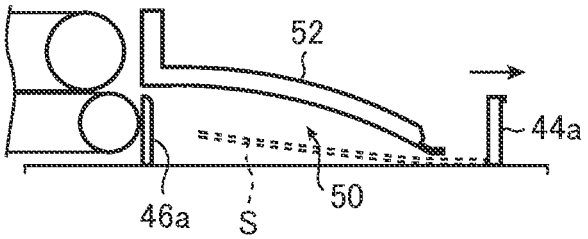
FIG. 9E is a schematic view of the sheet accumulating part in a state where the sheet that has been carried into the accumulating space has contacted the front stopper as seen from a front direction.
Figure 9F:
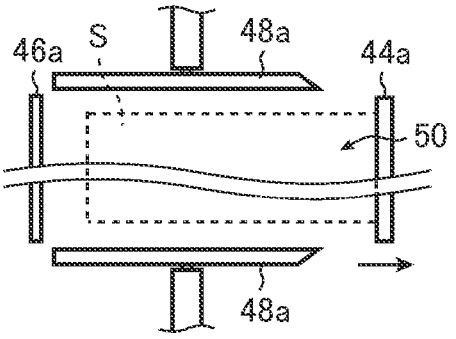
FIG. 9F is a schematic view of the state of FIG. 9E as seen from a planar direction.
Figure 9G:
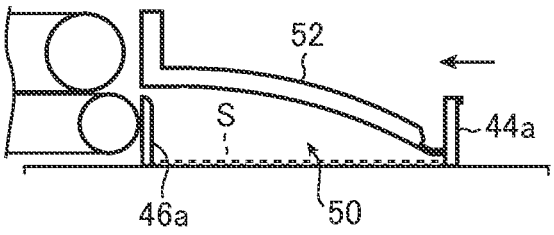
FIG. 9G is a schematic view of the sheet accumulating part in a state where paper alignment of the sheet that has been carried into the accumulating space has been performed as seen from a front direction.
Figure 9H:
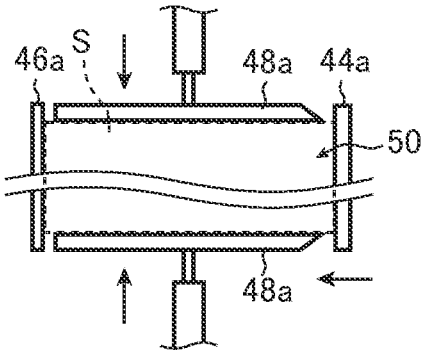
FIG. 9H is a schematic view of the state of FIG. 9G as seen from a planar direction.

Next, operation of the accumulating unit (first accumulating unit 22 and second accumulating unit 24) according to the present embodiment will be described using FIGS. 9A to 911. Note that FIG. 9A is a schematic view of the sheet accumulating part 40 in a state where the signature S has begun to enter the accumulating space 50 as seen from a front direction (width direction of accumulated sheets), and FIG. 9B is a schematic view of the state of FIG. 9A as seen from a planar direction (above). FIG. 9C is a schematic view of the sheet accumulating part 40 in a state immediately before the signature S carried into the accumulating space 50 contacts the front stopper 44*a* as seen from a front direction, and FIG. 9D is a schematic view of the state of FIG. 9C as seen from a planar direction. FIG. 9E is a schematic view of the sheet accumulating part 40 in a state where the signature S carried into the accumulating space 50 has contacted the front stopper 44*a* as seen from a front direction, and FIG. 9F is a schematic view of the state of FIG. 9E as seen from a planar direction. FIG. 9G is a schematic view of the sheet accumulating part 40 in a state where paper alignment of the signature S carried into the accumulating space 50 has been performed as seen from a front direction, and FIG. 9H is a schematic view of the state of FIG. 9G as seen from a planar direction. In FIGS. 9A to 9H, configurations unnecessary in description of operation of the accumulating unit (first accumulating unit 22 and second accumulating unit 24) are omitted from illustration.

As shown in FIGS. 9A to 9H, the first accumulating unit 22 (second accumulating unit 24), every time it receives a detection signal from the downstream side sensor 58, that is, every time the signature S conveyed by the first conveyor part (downstream side second conveyor part 28*b*) passes the downstream side sensor 58, operates each of the front stopper 44*a* and the pair of left and right side positioning plates 48*a* at an appropriate timing, and performs paper alignment in the carrying-in direction and the width direction of the signature S accumulated in the accumulating space 50, by the front stopper 44*a*, the pair of left and right side positioning plates 48*a*, and the rear positioning plate 46*a*. Moreover, the first accumulating unit 22 (second accumulating unit 24) decreases momentum of the signature S discharged (ejected) vigorously into the accumulating space 50 and achieves stable accumulation of the signature S, by operation of the front stopper 44*a* and by the frictional resistance increasing member 53 of the paper guide 52.

Specifically, first, at a timing after paper alignment of a preceding signature S (not illustrated) (in the description below, a signature S carried in one before the signature S to be paper aligned), that is, at a timing before the signature S conveyed by the first conveyor part 26 (downstream side second conveyor part 28*b*) enters the accumulating space 50 or immediately after said signature S has begun to enter the accumulating space 50, the pair of left and right side positioning plates 48*a* withdraw moving in a direction of moving away from each other. Note that as shown in FIGS. 9A and 9B, in a state where the signature S has begun to enter the accumulating space 50, the front stopper 44*a* is positioned at a position separated from the rear positioning plate 46*a* by an amount of a distance substantially equal to the length in the conveying direction of the signature S (that is, the paper alignment position).

The signature S carried in (discharged) vigorously to the sheet accumulating part 40 in such a state at substantially the same speed as the conveying speed (approximately 120 to 150 m/min) advances toward the front stopper 44*a* while being guided in an advancing direction by the paper guide 52. At this time, due to momentum of the signature S at time of entry and due to levitation force, centrifugal force, and so on, when the signature S moves along the lower surface of the arc-like formed paper guide 52, an upper surface of the signature S makes surface contact with the frictional resistance increasing member 53 provided on the lower surface of the paper guide 52, and momentum of the signature S at time of entry is gradually reduced by frictional resistance with the frictional resistance increasing member 53.

Then, as shown in FIGS. 9C and 9D, immediately before the signature S largely advancing along the paper guide 52 contacts the front stopper 44*a*, the front stopper 44*a* withdraws moving in a direction of moving away from the rear positioning plate 46*a*. By withdrawing the front stopper 44*a* in this way, impact when the signature S contacts the front stopper 44*a* is eased and occurrence of an accumulating defect due to rebounding of the signature S is suppressed. Note that a moving speed of the front stopper 44*a* at this time may be set to any speed, but is preferably a speed slightly slower than the advancing speed of the signature S advancing toward the front stopper 44*a*, that is, a speed such that the signature S contacts the stopper 44*a* during withdrawing (that is, before a withdrawing operation has been completed). By withdrawing the front stopper 44*a* at this kind of speed such that the signature S contacts the front stopper 44*a* during withdrawing, impact when the signature S contacts the front stopper 44*a* can be eased even more.

Then, as shown in FIGS. 9E and 9F, the front stopper 44*a* stops the withdrawing operation immediately after the signature S has contacted the stopper 44*a*.

As shown in FIGS. 9G and 9H, after the signature S has contacted the front stopper 44*a*, the front stopper 44*a* moves advancing in a direction of moving closer to the rear positioning plate 46*a* until reaching the paper alignment position. Moreover, similarly to the front stopper 44*a*, the pair of left and right side positioning plates 48*a* move advancing in a direction of moving closer to each other until reaching a position such that a distance between these pair of left and right side positioning plates 48*a* is substantially equal to the length in the width direction of the signature S and distances from the gap 42*a* of the table 42 to each of the side positioning plates 48*a* are equal (that is, the paper alignment position). By advancing the front stopper 44*a* and the pair of left and right side positioning plates 48*a* in this way, paper alignment in the carrying-in direction and the width direction of the signature S can be performed by each of the smooth surfaces of the front stopper 44*a*, the pair of left and right side positioning plates 48*a*, and the rear positioning plate 46*a*. At this time, the rear positioning plate 46*a* is pressed onto the table 42 by the bias mechanism 46*c*, and there is a state of there being substantially no gap between the lower end of the rear positioning plate 46*a* and the upper surface of the table 42, hence the signature S accumulated on the table 42 is prevented from entering between the lower end of the rear positioning plate 46*a* and the upper surface of the table 42.

Then, the above-described operation is executed continuously until a desired sheet stacked body is formed. Specifically, when the sheet stacked body is configured from one signature S, the chopper folding mechanism 60 operates immediately after the above-described series of operations has been executed, substantially a central portion in the width direction of the sheet stacked body configured from one signature S is pressed between the pair of folding rollers 70 by the chopper folding blade 62, and a folded-in-two signature form print product is formed to be carried out to the outside of the accumulating mechanism 10 (for example, to a collection box, or the like) by the delivery fan 72 and the delivery conveyor 74. Moreover, when the sheet stacked body is configured from any number of two or more signatures S, the chopper folding mechanism 60 operates immediately after the above-described series of operations has been executed the same number of times as said any number of two or more, and, similarly to above, a signature form print product folded in two by the chopper folding blade 62 and the pair of folding rollers 70 is formed to be carried out to the outside of the accumulating mechanism 10 (for example, to a collection box, or the like) by the delivery fan 72 and the delivery conveyor 74.

As described above, in the accumulating units 22 and 24 according to the present embodiment, the sheet accumulating part 40 comprises: the front positioning mechanism 44 (front positioning part) that is provided on the front side in the carrying-in direction of the sheet (signature S) carried into the sheet accumulating part 40 and that positions the front edge in the carrying-in direction of the sheet; and the rear positioning mechanism 46 (rear positioning part) that is provided facing the front positioning mechanism 44 on the rear side in the carrying-in direction of the sheet and that positions the rear edge in the carrying-in direction of the sheet, and the front positioning mechanism 44 is configured to, when the sheet has entered the sheet accumulating part 40, move away from the rear positioning mechanism 46 such that the distance of the front positioning mechanism 44 from the rear positioning mechanism 46 is larger than the length in the conveying direction of the sheet, and, after the front edge in the carrying-in direction of the sheet has contacted the front positioning mechanism 44, move closer to the rear positioning mechanism 46 such that the distance of the front positioning mechanism 44 from the rear positioning mechanism 46 is substantially equal to the length in the conveying direction of the sheet. Such accumulating units 22 and 24 make it possible to absorb and ease impact when the individual or signature form sheet carried in (ejected) vigorously to the sheet accumulating part 40 collides with the front positioning mechanism 44 by the moving operation of the front positioning mechanism 44, thereby making it possible to prevent occurrence of an accumulating defect due to rebounding of the sheet, hence the sheet stacked body can be overlaid in a good posture even during high speed operation where, for example, the conveying speed is approximately 120 to 150 m/min.

Moreover, because the accumulating units 22 and 24 according to the present embodiment comprise the paper guide 52 that guides fall of the sheet that has entered the sheet accumulating part 40, it is possible to reliably guide the sheet carried into the sheet accumulating part 40 to the front stopper 44*a*, hence occurrence of paper jamming or an accumulating defect can be more reliably prevented.

Specifically, because in the accumulating units 22 and 24 according to the present embodiment, a contact surface with the sheet (lower surface) of the paper guide 52 is provided with the frictional resistance increasing member 53 capable of increasing frictional resistance to more than when the sheet that has entered the sheet accumulating part 40 contacts the paper guide 52 directly, it is possible to decrease momentum of the sheet in a period until the sheet carried in (discharged) to the sheet accumulating part 40 reaches the front stopper 44*a*, hence impact when the sheet collides with the front stopper 44*a* can be reduced even more.

Furthermore, because in the accumulating units 22 and 24 according to the present embodiment, the leading edge horizontal portion 52*b* (leading edge on the front positioning mechanism 44 side) of the paper guide 52 is formed in a flat shape parallel to a surface of the sheet accumulated in the sheet accumulating part 40, it becomes possible to set to a horizontal state the front edge in the carrying-in direction of the sheet advancing toward the withdrawn front stopper 44*a*, hence occurrence of paper jamming or an accumulating defect can be reliably prevented even when forming the sheet stacked body from two or more sheets. That is, when for example a signature of small thickness is stacked on a signature of large thickness to form the sheet stacked body, there is a risk that the following signature of small thickness becomes entangled between the front edge in the carrying-in direction of the signature of large thickness and the withdrawn front stopper 44*a*, and that paper jamming or an accumulating defect occurs. To counter this, in the accumulating units 22 and 24 according to the present embodiment, the front edge in the carrying-in direction of the following sheet is directed in a horizontal direction by the leading edge horizontal portion 52*b* of the paper guide 52, hence the following signature of small thickness can be advanced toward the front stopper 44*a* without becoming entangled between the front edge in the carrying-in direction of the already accumulated sheet and the withdrawn front stopper 44*a*, hence occurrence of paper jamming or an accumulating defect can be reliably prevented.

Moreover, in the accumulating units 22 and 24 according to the present embodiment, the rear positioning mechanism 46 (rear positioning part) is configured to be movable in the direction of moving closer to or moving away from the front positioning mechanism 44 (front positioning part). Such accumulating units 22 and 24 make it possible to appropriately adjust the position of the rear positioning plate 46*a* that serves as a reference when performing paper alignment, hence make it possible to handle also so-called variable cutoff where the length in the conveying direction (cutoff) of the individual sheet is changed to any length.

Furthermore, in the accumulating units 22 and 24 according to the present embodiment, the sheet accumulating part 40 comprises the pair of side positioning mechanisms 48 (pair of side positioning parts) that positions the position in the width direction of the sheet (signature S) accumulated in the sheet accumulating part 40, hence paper alignment in the width direction of the sheet can also be performed in addition to paper alignment in the carrying-in direction of the sheet.

Specifically, in the accumulating units 22 and 24 according to the present embodiment, at least one of the pair of side positioning mechanisms 48 (pair of side positioning parts) is configured to, when the sheet is accumulated in the sheet accumulating part 40, move away from the other of the side positioning mechanisms 48 such that the distance between the pair of side positioning mechanisms 48 is larger than the length in the width direction of the sheet, and then move closer to the other of the side positioning mechanisms 48 such that the distance between the pair of side positioning mechanisms 48 is substantially equal to the length in the width direction of the sheet. Such accumulating units 22 and 24 make it possible to prevent the sheet from riding up on the pair of side positioning mechanisms 48, and moreover make it possible to reliably perform sheet alignment in the width direction of the sheet by the pair of side positioning mechanisms 48 even when the sheet has collided with the front stopper 44*a* and rebounded, hence the sheet can be accumulated in a good posture.

Moreover, because the accumulating units 22 and 24 according to the present embodiment comprise the chopper folding mechanism 60 that is provided above the region of the sheet accumulating part 40 where the sheet stacked body is accumulated (accumulating space 50) and that folds in two the sheet stacked body accumulated in the sheet accumulating part 40, it becomes possible to perform chopper folding directly at a timing when a certain number of copies of the individual or signature form sheet have finished being overlaid and specifically it becomes possible to speed up running speed of the device even when continuously producing a thin page signature form print product such as a single sheet single section. That is, when for example producing a four page single section which is a minimum unit of a newspaper signature, the device disclosed in above-described Patent Document 1 guides the section signature formed by sideways-folding one sheet on which four pages including both sides have been printed to the accumulating part of the section signature accumulating device, discharges a signature stacked body of a single sheet single section configured from one copy only of this single sheet section signature from the accumulating part to the delivery mechanism without overlaying the following section signature, and lengthways-folds the signature stacked body in the chopper folding mechanism to produce the four page single section. In this case, as a result, the section signatures get produced one after another without sheets being overlaid in the folding cylinder of the section formation unit, and the section signature accumulating device that has received these section signatures does not perform overlaying of the section signatures in the accumulating part, hence sends forth section signature stacked bodies one after another to the delivery mechanism on a downstream side. However, the delivery mechanism is an intermittently operating delivery conveyor and operates so as to receive the section signature stacked bodies from the section signature accumulating device on its conveying surface in a stopped state and operate at an appropriate timing after receipt to convey the received section signature stacked bodies to the chopper folding mechanism on a downstream side, hence there is a problem that particularly when the device runs at high speed, the very operation of the delivery mechanism fails to keep up with the section signature stacked bodies coming one after another and running speed cannot be raised. To counter this, the accumulating units 22 and 24 according to the present embodiment are configured to continuously execute both accumulation of sheets and chopper folding in the same place (the sheet accumulating part 40), hence running speed can be speeded up even when continuously producing a thin page signature form print product, and moreover, any of various kinds of section configurations (print product configurations) can be achieved.

Furthermore, in the accumulating mechanism 10 according to the present embodiment, the chopper folding mechanism 60 is attached to the device inner frame IF, hence it is possible to perform positional adjustment of the chopper folding mechanism 60 such that the folding line by the chopper folding mechanism 60 is at the center in the width direction of the sheet accumulating body simply by moving the device inner frame IF in the width direction of the signature S without performing positional adjustment of the signature S on the conveying path of the first conveyor part 26 (second conveyor part 28). Moreover, in the accumulating mechanism 10 according to the present embodiment, the table 42 and front positioning mechanism 44 of the sheet accumulating part 40, the pair of folding rollers 70, the delivery fan 72, and the delivery conveyor 74 are also attached to the device inner frame IF along with the chopper folding mechanism 60, hence it is possible to move each of these configurative elements in an integrated manner along with the chopper folding mechanism 60, leading to an advantage that adjustment of relative positions of each of these configurative elements need to be performed every time.

That concludes description of a preferred embodiment of the present invention, but the technical scope of the present invention is not limited to the scope described in the above-mentioned embodiment. Various changes or improvements may be added to the above-described embodiment.

For example, in the above-mentioned embodiment, the print product production device 1 was described as comprising the continuous paper supply unit 2, the ink jet printing unit 4, and the print surface monitoring unit 6. However, the present invention is not limited to this configuration, and a variety of configurations may be adopted. For example, a variety of publicly known paper feed mechanisms such as an individual sheet supply unit that supplies a sheet already individually cut may be adopted as a paper feed mechanism, rather than the continuous paper supply unit 2 that supplies the continuous paper W. Moreover, a variety of publicly known printing mechanisms such as a rotary printing unit that performs offset printing may be adopted as a printing mechanism, rather than the ink jet printing unit 4 that performs ink jet printing (digital printing). Furthermore, the print surface monitoring unit 6 need not be installed.

In addition, the above-mentioned embodiment was described taking the folding device 8 comprising the cutting mechanism 12, the conveyor mechanism 14, the folding cylinder 16, and the jaw cylinder 18 as an example of a folding mechanism for producing the signature. However, the present invention is not limited to this folding device 8, and a variety of publicly known folding mechanisms may be adopted. Moreover, when the sheet stacked body formed by the accumulating units 22 and 24 is formed by stacking an individual sheet rather than a signature form sheet (signature S), a folding mechanism such as the folding device 8 need not be installed.

Furthermore, in the above-mentioned embodiment, it was described as being due to the folding cylinder 16 of the folding device 8 being a 2 times cylinder that produces a signature of identical configuration two at a time, that two accumulating units 22 and 24 of the accumulating mechanism 10 are installed. However, the present invention is not limited to this configuration. That is, when the folding cylinder 16 of the folding device 8 is an N (where N is any integer of 1 or more) times cylinder that produces a signature of identical configuration N at a time or when the folding mechanism provided on an upstream side of the accumulating mechanism 10 is a folding mechanism capable of forming N individual or signature form sheets of identical configuration at a time and conveying these to the accumulating mechanism 10, rather than a rotary folding mechanism like the folding device 8, it may be configured that N accumulating units are installed. Note that when only one accumulating unit is installed, the accumulating mechanism 10 need only comprise at least the first accumulating unit 22 and the first conveyor part 26. Moreover, when three or more accumulating units are installed, in addition to installing the configuration of the accumulating mechanism 10 according to the above-mentioned embodiment, it is only required to appropriately further install: the third and greater accumulating units; one or a plurality of conveyor parts that convey the sheets distributed to each of the third and greater accumulating units; and one or a plurality of switching parts that distribute the sheets to each of the conveyor parts.

In addition, the above-mentioned embodiment was described taking a carrying-out mechanism comprising the pair of folding rollers 70, the delivery fan 72, and the delivery conveyor 74 as an example of a carrying-out mechanism that carries out the print product chopper-folded by the chopper folding mechanism 60. However, the present invention is not limited to this carrying-out mechanism, and a variety of publicly known carrying-out mechanisms may be adopted.

Furthermore, the above-mentioned embodiment was described as having the chopper folding mechanism 60 provided above the region of the sheet accumulating part 40 where the sheet stacked body is accumulated (accumulating space 50). However, the present invention is not limited to this configuration, and it is also possible to adopt a configuration that conveys the sheet stacked body formed by the sheet accumulating part 40 by an appropriate conveying mechanism and performs chopper folding by a chopper folding mechanism provided at a conveying destination.

Still further, in the above-mentioned embodiment, the sheet accumulating part 40 was described as comprising the paper guide 52 and the auxiliary guide 54. However, the present invention is not limited to this configuration, and it is possible to adopt a configuration not comprising the paper guide 52 and the auxiliary guide 54. Moreover, in the above-mentioned embodiment, the paper guide 52 was described as including the curved inclined portion 52*a* and the leading edge horizontal portion 52*b*. However, the present invention is not limited to this configuration, and a variety of shapes may be adopted for the paper guide 52, provided that the paper guide 52 is capable of guiding the sheet toward the front positioning mechanism 44. Furthermore, in the above-mentioned embodiment, the lower surface of the paper guide 52 was described as being provided with the frictional resistance increasing member 53. However, the present invention is not limited to this configuration, and it is possible to adopt a configuration where the frictional resistance increasing member 53 is not provided.

Moreover, in the above-mentioned embodiment, the rear positioning plate 46*a* of the rear positioning mechanism 46 was described as being configured to be movable in the direction of moving closer to or moving away from the front stopper 44*a*. However, the present invention is not limited to this configuration, and the rear positioning plate may be fixed immovably.

Furthermore, in the above-mentioned embodiment, the sheet accumulating part 40 was described as comprising the pair of side positioning mechanisms 48 that positions the position in the width direction of the sheet accumulated in the sheet accumulating part 40. However, the present invention is not limited to this configuration, and it is possible to adopt a configuration not comprising the pair of side positioning mechanisms 48.

Still further, in the above-described embodiment, both of the pair of side positioning mechanisms 48 were described as being movable side positioning mechanisms that move in the direction of moving closer to or moving away from each other. However, the present invention is not limited to this configuration, and it is possible for only one to be a movable side positioning mechanism or for both to be fixed immovably.

It is clear from descriptions of scope in the patent claims that modified examples of the kind described above are included in the scope of the present invention.

What is claimed is:

1. An accumulating unit for accumulating in a sheet accumulating part an individual or signature form sheet carried from an upstream side, the sheet accumulating part comprising:

a front positioning part (44) that is provided on a front side in a carrying-in direction of the sheet carried into said sheet accumulating part and that positions a front edge in the carrying-in direction of the sheet; and a rear positioning part (46) that is provided facing the front positioning part on a rear side in the carrying-in direction of said sheet and that positions a rear edge in the carrying-in direction of the sheet, the front positioning part being configured to, when the sheet has entered the sheet accumulating part, move away from the rear positioning part such that a distance of the front positioning part from the rear positioning part is larger than a length of the sheet in the carrying-in direction of the sheet, and, after the front edge in the carrying-in direction of the sheet has contacted the front positioning part, move closer to the rear positioning part such that the distance of the front positioning part from the rear positioning part is substantially equal to the length of the sheet in the carrying-in direction of the sheet, wherein the sheet accumulating part further comprises a paper guide (52) provided above an accumulating position between the front positioning part and the rear positioning part, and the paper guide includes an inclined portion that inclines downward toward the accumulating position and that is configured to guide the sheet that has entered the sheet accumulating part to the accumulating position by a lower surface of the inclined portion, and wherein a leading edge on a front positioning part side of the inclined portion is horizontal and bent in a direction toward the front positioning part.

2. The accumulating unit according to claim 1, wherein the lower surface of the inclined portion is provided with a frictional resistance increasing member that increases frictional resistance to more than when the sheet that has entered the sheet accumulating part contacts the lower surface of the inclined portion directly.

3. The accumulating unit according to claim 2, wherein the rear positioning part is configured to be movable in a direction of moving closer to or moving away from the front positioning part.

4. The accumulating unit according to claim 3, wherein the sheet accumulating part further comprises a pair of side positioning parts that positions a position in a width direction of the sheet accumulated in said sheet accumulating part.

5. The accumulating unit according to claim 4, wherein at least one of the pair of side positioning parts is configured to move away from the other of the side positioning parts such that a distance between the pair of side positioning parts is larger than a length of the sheet in the width direction of the sheet, and then move closer to the other of the side positioning parts such that the distance between the pair of side positioning parts is substantially equal to the length of the sheet in the width direction of the sheet.

6. The accumulating unit according to claim 5, further comprising a chopper folding mechanism that is provided above a region of the sheet accumulating part where the sheet is accumulated and that folds in two a sheet stacked body configured from one or a plurality of sheets accumulated in said sheet accumulating part.

7. The accumulating unit according to claim 1, wherein the rear positioning part is configured to be movable in a direction of moving closer to or moving away from the front positioning part.

8. The accumulating unit according to claim 1, wherein the sheet accumulating part further comprises a pair of side positioning parts that positions a position in a width direction of the sheet accumulated in said sheet accumulating part.

9. The accumulating unit according to claim 8, wherein at least one of the pair of side positioning parts is configured to move away from the other of the side positioning parts such that a distance between the pair of side positioning parts is larger than a length of the sheet in the width direction of the sheet, and then move closer to the other of the side positioning parts such that the distance between the pair of side positioning parts is substantially equal to the length of the sheet in the width direction of the sheet.

10. The accumulating unit according to claim 1, further comprising a chopper folding mechanism that is provided above a region of the sheet accumulating part where the sheet is accumulated and that folds in two a sheet stacked body configured from one or a plurality of sheets accumulated in said sheet accumulating part.

11. A print product production device, comprising:

an upstream side conveyor part that conveys an individual or signature form sheet on which printing has been performed;

a plurality of accumulating units; and a distributing and conveying part that is provided between the upstream side conveyor part and the plurality of accumulating units and that distributes and conveys the sheet conveyed by the upstream side conveyor part to each of the plurality of accumulating units, the plurality of accumulating units each accumulating unit comprising:

a front positioning part (44) that is provided on a front side in a carrying-in direction of the sheet carried into said sheet accumulating part and that positions a front edge in the carrying-in direction of the sheet; and a rear positioning part (46) that is provided facing the front positioning part on a rear side in the carrying-in direction of said sheet and that positions a rear edge in the carrying-in direction of the sheet, the front positioning part being configured to, when the sheet has entered the sheet accumulating part, move away from the rear positioning part such that a distance of the front positioning part from the rear positioning part is larger than a length of the sheet in the carrying-in direction of the sheet, and, after the front edge in the carrying-in direction of the sheet has contacted the front positioning part, move closer to the rear positioning part such that the distance of the front positioning part from the rear positioning part is substantially equal to the length of the sheet in the carrying-in direction of the sheet.

12. A print product production device, comprising:

an upstream side conveyor part that conveys an individual or signature form sheet on which printing has been performed;

a plurality of accumulating units; and a distributing and conveying part that is provided between the upstream side conveyor part and the plurality of accumulating units and that distributes and conveys the sheet conveyed by the upstream side conveyor part to each of the plurality of accumulating units, the plurality of accumulating units comprising:

a front positioning part (44) that is provided on a front side in a carrying-in direction of the sheet carried into said sheet accumulating part and that positions a front edge in the carrying-in direction of the sheet; and a rear positioning part (46) that is provided facing the front positioning part on a rear side in the carrying-in direction of said sheet and that positions a rear edge in the carrying-in direction of the sheet, the front positioning part being configured to, when the sheet has entered the sheet accumulating part, move away from the rear positioning part such that a distance of the front positioning part from the rear positioning part is larger than a length of the sheet in the carrying-in direction of the sheet, and, after the front edge in the carrying-in direction of the sheet has contacted the front positioning part, move closer to the rear positioning part such that the distance of the front positioning part from the rear positioning part is substantially equal to the length of the sheet in the carrying-in direction of the sheet;

a chopper folding mechanism that is provided above a region of the sheet accumulating part where the sheet is accumulated and that folds in two a sheet stacked body configured from one or a plurality of sheets accumulated in said sheet accumulating part.

* * * * *